US011042106B2

(12) United States Patent
Matsuo et al.

(10) Patent No.: US 11,042,106 B2
(45) Date of Patent: Jun. 22, 2021

(54) IMAGE FORMING APPARATUS HAVING REMOVABLE TRANSFER UNIT

(71) Applicant: CANON KABUSHIKI KAISHA, Tokyo (JP)

(72) Inventors: Makoto Matsuo, Kashiwa (JP); Shinichi Onodera, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/599,703

(22) Filed: Oct. 11, 2019

(65) Prior Publication Data

US 2020/0041936 A1 Feb. 6, 2020

Related U.S. Application Data

(63) Continuation of application No. PCT/JP2018/016225, filed on Apr. 13, 2018.

(30) Foreign Application Priority Data

Apr. 14, 2017 (JP) ..... JP2017-080760

(51) Int. Cl.
*G03G 15/16* (2006.01)

(52) U.S. Cl.
CPC ..... *G03G 15/161* (2013.01); *G03G 15/162* (2013.01); *G03G 15/1615* (2013.01)

(58) Field of Classification Search
CPC ..... G03G 15/161; G03G 15/162; G03G 15/1675; G03G 15/1615
See application file for complete search history.

(56) References Cited

U.S. PATENT DOCUMENTS 6,308,034 B1 10/2001 Nakashima et al.
7,454,158 B2 * 11/2008 Nakano ..... G03G 21/1647 399/110
8,081,920 B2 12/2011 Tanaka
2006/0210315 A1 9/2006 Nakamura et al.
(Continued)

FOREIGN PATENT DOCUMENTS

JP 10-78703 A 3/1998
JP 2000-221791 A 8/2000
(Continued)

OTHER PUBLICATIONS

International Search Report and Written Opinion dated Jul. 10, 2018, in corresponding International Patent Application No. PCT/JP2018/016225.

*Primary Examiner* — Hoang X Ngo
(74) *Attorney, Agent, or Firm* — Venable LLP

(57) ABSTRACT

An image forming apparatus includes a transfer unit for which, when inclined, leakage of a liquid developer can be suppressed. The transfer unit includes an intermediary transfer belt onto which the liquid developer is transferred and which rotates. A supporting unit is capable of holding the transfer unit at a first position. A rotation holding portion is capable of holding the transfer unit at a second position inclined from the first position relative to the supporting unit. A cleaning roller is capable of removing the liquid developer on the intermediary transfer belt. A cleaning container is supported by the supporting unit irrespective of rotation of the transfer unit and is capable of collecting the liquid developer removed by the cleaning roller.

4 Claims, 14 Drawing Sheets

(56) References Cited

U.S. PATENT DOCUMENTS

| | | | |
|---|---|---|---|
| 2007/0048005 | A1 | 3/2007 | Nakano et al. |
| 2009/0010694 | A1 | 1/2009 | Jang et al. |
| 2009/0190979 | A1 | 7/2009 | Tanaka |

FOREIGN PATENT DOCUMENTS

| | | | |
|---|---|---|---|
| JP | 2001-013838 | A | 1/2001 |
| JP | 2001-296746 | A | 10/2001 |
| JP | 2002-174969 | A | 6/2002 |
| JP | 2003-066809 | A | 3/2003 |
| JP | 2005-309036 | A | 11/2005 |
| JP | 2006-251670 | A | 9/2006 |
| JP | 2007-057952 | A | 3/2007 |
| JP | 2009-205130 | A | 9/2009 |

* cited by examiner

IMAGE FORMING APPARATUS HAVING REMOVABLE TRANSFER UNIT

TECHNICAL FIELD

The present invention relates to an image forming apparatus, such as a copying machine, a printer, a facsimile machine or a multi-function machine having a plurality of functions of these machines.

BACKGROUND ART

As an image forming apparatus, a constitution in which a toner image is transferred from a photosensitive drum as an image bearing member onto an intermediary transfer belt as a transfer member has been known. Further, when a transfer unit including such an intermediary transfer belt is subjected to maintenance, a constitution in which the transfer unit is pulled out together with a gear unit from an apparatus main assembly and is inclined relative to the supporting unit has been proposed (Japanese Laid-Open Application (JP-A) 2005-309036).

Here, as the image forming apparatus, a constitution in which the toner image is formed using a liquid developer containing toner and a carrier liquid has been conventionally known. In the case where in such a constitution using the liquid developer, the transfer unit is inclined during maintenance as in JP-A 2005-309036, there is a possibility that the liquid developer deposited on a part of the transfer unit flows along an inclination direction and leaks to an unintended portion.

That is, in the case of JP-A 2005-309036, a constitution using powdery toner is employed, and therefore, a possibility of toner leakage is low even when the transfer unit is inclined. On the other hand, in the case of a constitution using the liquid developer, the liquid developer is liable to flow along a wall surface compared with the powder. Further, even when the constitution in which the transfer unit is inclined is not employed, there is a liability that the liquid developer leaks to an outside by flowing along a shaft portion of a roller member stretching the belt through the intermediary transfer belt and has an influence on a peripheral member. For example, there is a liability that the liquid developer enters a bearing portion of the roller and increases a driving torque and that the liquid developer enters an electric contact portion or the like of the roller and electrical connection becomes unstable.

SUMMARY OF THE INVENTION

Problem to be Solved by the Invention

The present invention aims at providing an image forming apparatus, in which image formation is carried out using a liquid developer transferred on an intermediary transfer belt, capable of suppressing leakage of the liquid developer along a shaft portion of a rotatable member contacting a transfer belt.

Means for Solving the Problem

According to an aspect of the present invention, there is provided an image forming apparatus comprising:

- an image bearing member for bearing an image formed with a developer containing toner and a carrier;
- an endless intermediary transfer belt onto which the image is transferred from the image bearing member;

- a transfer roller for transferring the image onto the intermediary transfer belt, wherein the transfer roller includes a roller portion contacting an inner peripheral surface of the intermediary transfer belt and a shaft portion having a diameter smaller than a diameter of the roller portion on an outside of the roller portion;
- a bearing portion for rotatably supporting the shaft portion; and
- a flange portion provided between the roller portion and the bearing portion with respect to an axial direction of the transfer roller.

According to another aspect of the present invention, there is provided an image forming apparatus comprising:

- an image bearing member for bearing an image formed with a developer containing toner and a carrier;
- an endless intermediary transfer belt onto which the image is transferred from the image bearing member;
- a transfer roller for transferring the image onto the intermediary transfer belt, wherein the transfer roller includes a roller portion contacting an inner peripheral surface of the intermediary transfer belt and a shaft portion having a diameter smaller than a diameter of the roller portion on an outside of the roller portion;
- a bearing portion for rotatably supporting the shaft portion;
- an electrical contact portion, contacting the shaft portion at a contact portion, for supplying a bias to the shaft portion; and
- a flange portion positioned between the roller portion and the electrical contact portion with respect to an axial direction of the transfer roller.

According to a further aspect of the present invention, there is provided an image forming apparatus comprising:

- an image bearing member for bearing an image formed with a developer containing toner and a carrier;
- an endless intermediary transfer belt onto which the image is transferred from the image bearing member;
- a cleaning roller for cleaning the intermediary transfer belt in contact with an inner surface or an outer surface of the intermediary transfer belt, wherein the cleaning roller includes a roller portion contacting the intermediary transfer belt and a shaft portion having a diameter smaller than a diameter of the roller portion on an outside of the roller portion;
- a bearing portion for rotatably supporting the shaft portion;
- an electrical contact portion, contacting the shaft portion at a contact portion for supplying a bias to the shaft portion or for grounding the shaft portion; and
- a flange portion provided between the roller portion and the bearing portion with respect to an axial direction of the transfer roller.

EMBODIMENTS FOR CARRYING OUT THE INVENTION

First Embodiment

A first embodiment will be described using FIG. 1 to FIG. 5. First, a schematic structure of an image forming apparatus of this embodiment will be described using FIG. 1.

[Image Forming Apparatus]

Figure 1:
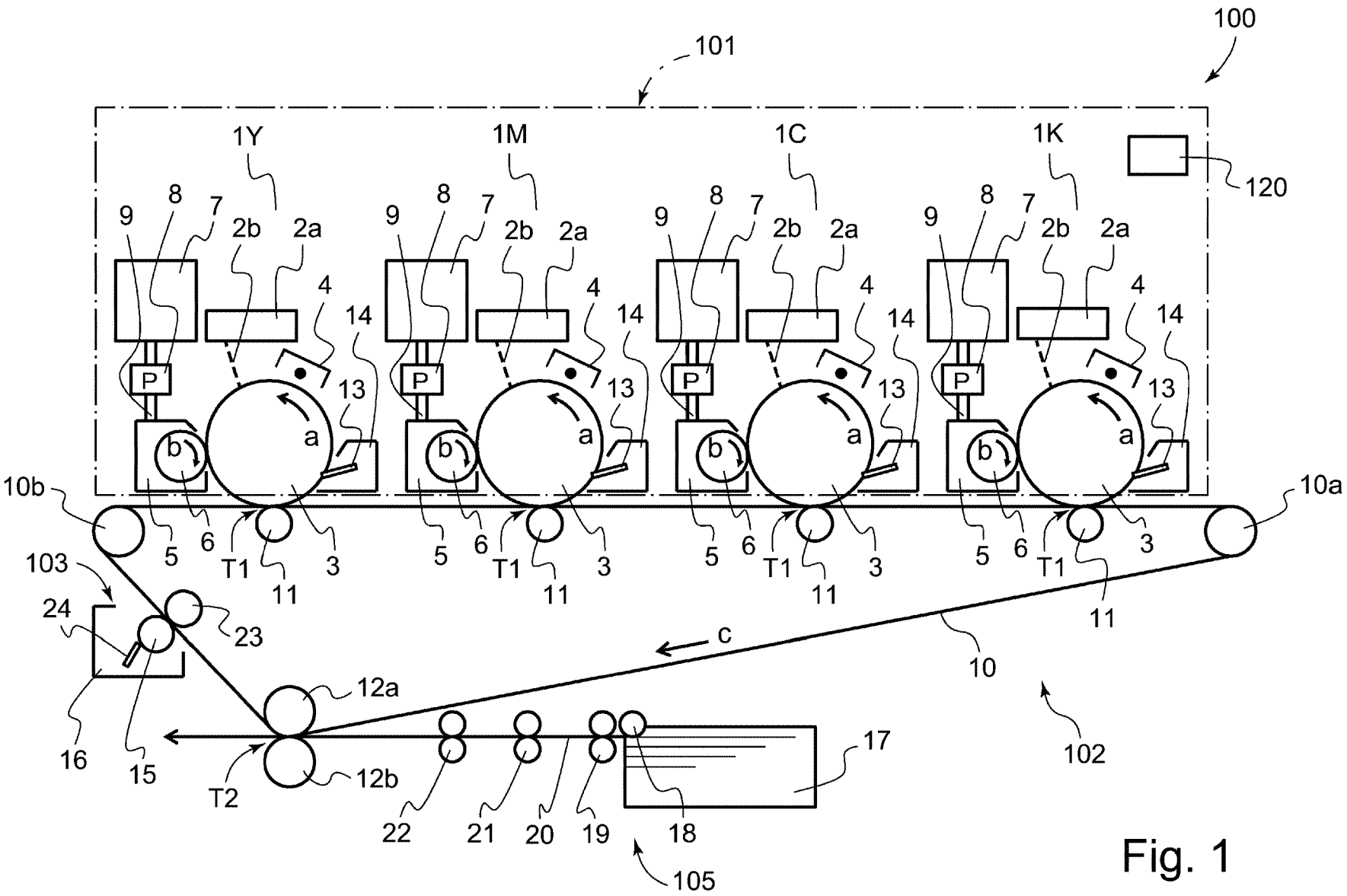
FIG. 1 is a schematic structural view of an image forming apparatus according to a first embodiment.

As shown in FIG. 1, an image forming apparatus 100 is a full-color printer of an electrophotographic type in which four image forming portions 1Y, 1M, 1C and 1K are provided correspondingly to four colors of yellow (Y), magenta (M), cyan (C) and black (K). In this embodiment, the image forming apparatus 100 is of a tandem type in which the image forming portions 1Y, 1M, 1C and 1K are provided along a rotational direction of an intermediary transfer belt 10 (described later). The image forming apparatus 100 forms a toner image on a recording material depending on an image signal from an external device, such as a personal computer, communicatably connected with an image forming apparatus main assembly, for example. As the recording material, a sheet material such as a sheet, a plastic film, a cloth or the like is cited.

Figure 3:
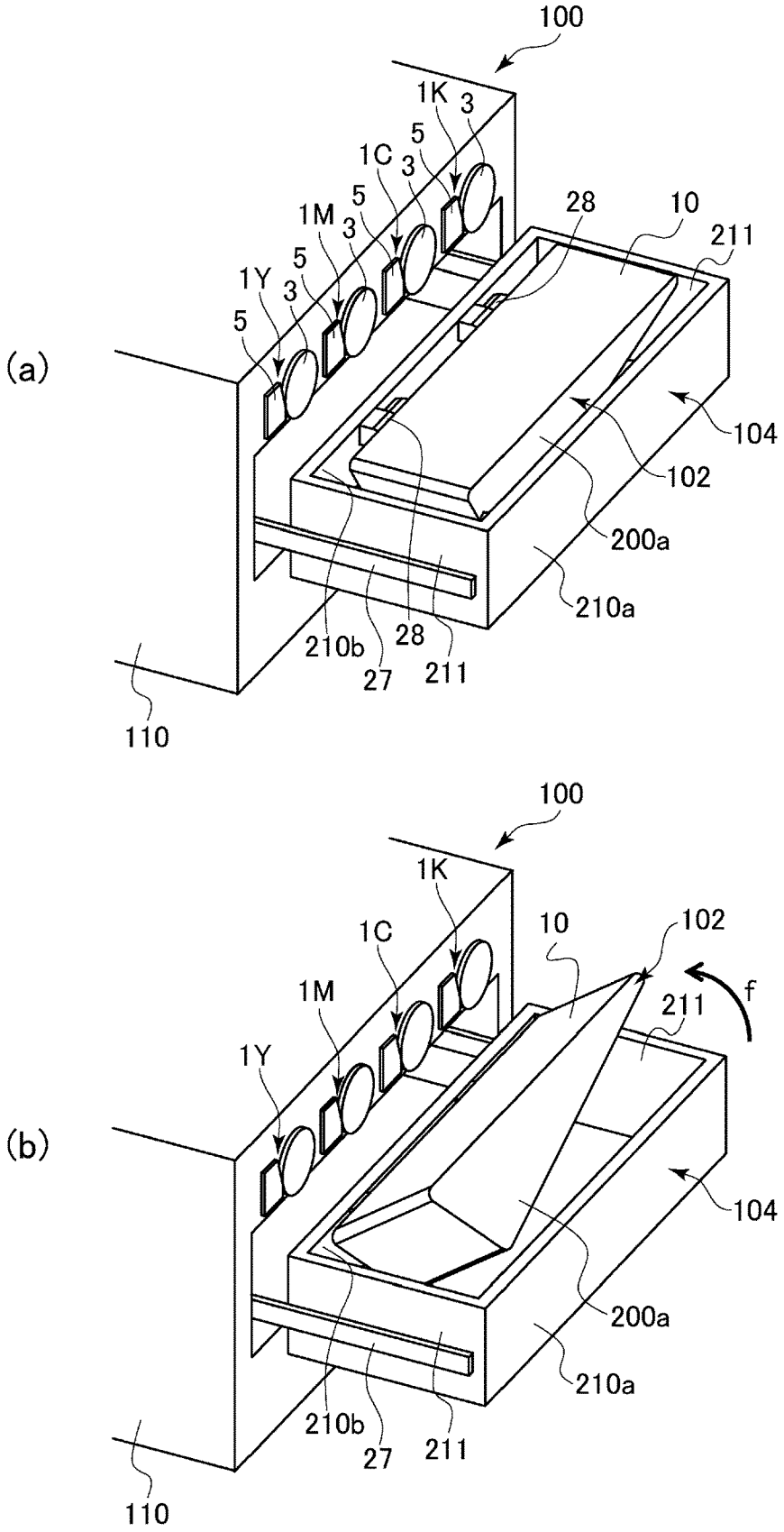
FIG. 3 includes schematic structural perspective views of a supporting unit according to the first embodiment, in which part (a) shows a pulled-out state, and part (b) shows an inclined state.

The image forming apparatus 100 includes an image forming unit 101, a transfer unit 102, a transfer cleaning portion 103, a supporting unit 104 (see parts (a) and (b) of FIG. 3), a recording material feeding portion 105, and a casing (see parts (a) and (b) of FIG. 3) capable of accommodating these members. The image forming apparatus 100 receives information (image signal) on image data from an external terminal (not shown). The received image data is processed by a CPU of a controller 120 for carrying out control of entirety of the image forming apparatus 100. Then, in the image forming portions 1Y, 1M, 1C and 1K for the respective colors of the image forming unit 101, toner images of the respective colors are formed.

Incidentally, the four image forming portions 1Y, 1M, 1C and 1K have the substantially same constitution except that development colors are different from each other. Accordingly, in the following, the image forming portion 1Y will be described as a representative, and other image forming portions will be omitted from description.

The image forming portion 1Y includes a cylindrical photosensitive member as an image bearing member capable of bearing the toner image, i.e., includes a photosensitive drum 3. At a periphery of the photosensitive drum 3, along a rotational direction a thereof, a charging device 4 for electrically charging the photosensitive drum 3, an exposure device (laser scanner) 2*a* for forming an electrostatic latent image on the charged photosensitive drum 3, a developing device 5, a drum cleaning member 13 and the like are provided.

When an image is formed, the photosensitive drum 3 is charged by the charging device 4 and is irradiated at a non-image portion with laser output light 2*b* based on the image information by the exposure device 2*a*, so that the electrostatic latent image is formed on the photosensitive drum 3. To the electrostatic latent image formed on the photosensitive drum 3, a liquid developer containing toner and a carrier liquid is supplied by a developing roller 6 rotating in a rotational direction b while being held (supported) by a container of the developing device 5. By this, the electrostatic latent image on the photosensitive drum 3 is developed by the toner, so that the toner image is formed on the photosensitive drum 3.

The liquid developer is a mixed liquid in which the toner is mixed in the carrier liquid. The liquid developer containing the toner and the carrier liquid is supplied from a developer bottle 7 into the container of the developing device 5 through a developer feeding path 9 by a developer supply pump 8.

The toner image formed on the photosensitive drum 3 is primary-transferred onto the intermediary transfer belt 10 as a transfer member of the transfer unit 102. The intermediary transfer belt 10 is an endless belt and is stretched by stretching rollers 10*a* and 10*b* and a secondary transfer inner roller 12*a* which are a plurality of stretching rollers. Further, between the stretching rollers 10*a* and 10*b*, a primary transfer roller 11 is provided so as to sandwich the intermediary transfer belt 10 between itself and the photosensitive drum 3. The primary transfer roller 11 is urged toward the photosensitive drum 3 by a spring as an unshown urging means. Further, a primary transfer portion T1 is formed between the photosensitive drum 3 and the primary transfer roller 11.

The intermediary transfer belt 10 is rotationally driven in an arrow c direction by the stretching roller 10*a* which is also a driving roller. By applying a voltage (primary transfer bias) to each of the primary transfer rollers 11, at the respective primary transfer portions T1, the toner images on the photosensitive drums 3 are successively transferred superposedly, so that a full-color toner image is formed on the intermediary transfer belt 10 (on the transfer member). At this time, the liquid developer is also supplied from the photosensitive drums to the intermediary transfer belt 10. Accordingly, on the intermediary transfer belt 10, the liquid developer is to be transferred.

On an outer peripheral surface of the intermediary transfer belt 10 stretched by the secondary transfer inner roller 12*a*, a secondary transfer outer roller 12*b* is provided so as to contact the intermediary transfer belt 10. Further, between the secondary transfer inner surface 12*a* and the secondary transfer outer roller 12*b*, a secondary transfer portion T2 is formed. The toner images on the intermediary transfer belt 10 are transferred, at the secondary transfer portion T2, onto a recording material fed by a recording material feeding portion 105 described later) under application of a voltage (secondary transfer bias) to the secondary transfer outer roller 12*b*. Incidentally, the secondary transfer bias may also be applied to the secondary transfer inner roller 12*a* by changing a polarity thereof from a polarity of the secondary transfer outer roller 12*b*.

The liquid developer remaining on the photosensitive drum 3 after the transfer thereof onto the intermediary transfer belt 10 is removed by a drum cleaning member 13 and is collected in a drum cleaning container 14. Further, the liquid developer remaining on the intermediary transfer belt 10 after the transfer thereof onto the recording material is removed by a transfer cleaning portion 103. A detailed structure of the transfer cleaning portion 103 will be described later.

Next, the recording material feeding portion 105 will be described. The recording materials are stacked on a feeding deck 17. A size of the stacked recording materials is detected by an unshown size detecting portion or by setting by a user and a serviceman and the like. When the recording materials are fed, an uppermost portion recording material stacked on the feeding deck 17 is picked up by a pick-up roller 18 and is separated in a single sheet by a separation roller pair 19 provided downstream of the pick-up roller 18. Then, the recording material fed from the feeding deck 17 is fed to a feeding path 20.

The recording material fed to the feeding path 20 is fed to a registration roller pair 22 by a feeding roller pair 21. The registration roller pair 22 temporarily stops rotation thereof, and the recording material is abutted against the registration roller pair 22, so that deviation of the recording material in a (recording material) feeding direction is corrected. Then, the registration roller pair 22 feeds the recording material to the secondary transfer portion T2 in synchronism with timing of the toner images (images) formed on the liquid developer held by the intermediary transfer belt 10. By this, deviation of the toner images to be transferred on the recording material is corrected to an appropriate position. The toner images transferred on the recording material at the secondary transfer portion are fixed on the recording material in a fixing unit (not shown).

[Transfer Cleaning Portion]

Figure 2:
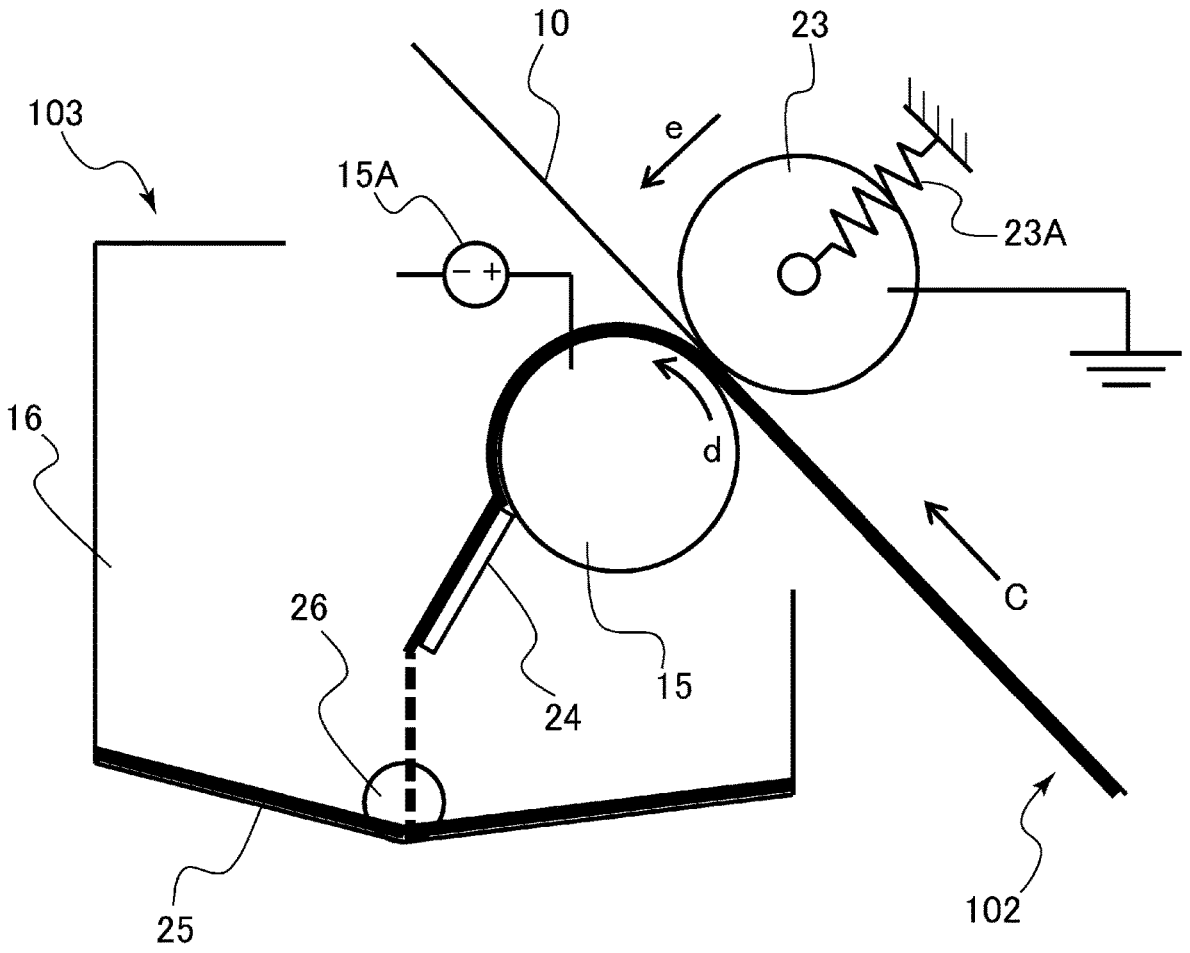
FIG. 2 is a schematic structural view of an image forming portion according to the first embodiment.

Next, a structure of the transfer cleaning portion 103 will be described using FIG. 2. The transfer cleaning portion 103 includes a cleaning roller 15 as a cleaning member (cleaning roller), a cleaning blade 24 and a cleaning container 16 as a collecting portion. At a position opposing the cleaning roller 15 while sandwiching the intermediary transfer belt 10 with the cleaning roller 15, an opposing roller 23 is provided so as to sandwich the intermediary transfer belt 10 between itself and the cleaning roller 15.

The cleaning roller 15 is rotationally driven by an unshown motor in an arrow d direction along the rotational direction c of the intermediary transfer belt 10 while contacting the outer peripheral surface of the intermediary transfer belt 10 on which the liquid developer deposits. To the cleaning roller 15, a voltage (cleaning bias) is applied from a voltage source 15A. The opposing roller 23 is connected to the ground.

The toner remaining on the intermediary transfer belt 10 is charged by negative electric charges, and therefore, a positive voltage opposite in polarity to the charge polarity of the toner is applied from the voltage source 15A to the cleaning roller 15. To the cleaning roller 15, the bias is applied from the voltage source 15A through an electric contact portion contacting a shaft portion 29*b* of the cleaning roller 15. The opposing roller 23 is connected to the ground, and therefore, such a voltage is applied to the cleaning roller 15, so that the toner remaining on the intermediary transfer belt 10 is electrophoretically moved to the cleaning roller 15.

At this time, in order to bring the cleaning roller 15 into contact with the intermediary transfer belt 10 reliably, by urging the opposing roller 23 in an arrow e direction by a spring 23A as an urging member, the intermediary transfer belt 10 is pressed against the cleaning roller 15. Thus, the cleaning roller 15 is contacted to the intermediary transfer belt 10 and the voltage is applied to the cleaning roller 15, and thus the toner is electrophoretically moved, so that the liquid developer containing the toner remaining on the intermediary transfer belt 10 can be removed by the cleaning roller 15.

The cleaning blade 24 is disposed so as to be contacted to the cleaning roller 15 with an acute angle with respect to the rotational direction d of the cleaning roller 15. That is, an angle formed between a portion, with respect to the rotational direction d, downstream of a contact point of a tangential line of an outer peripheral surface of the cleaning roller 15 passing through the contact point where the cleaning roller 15 and the cleaning blade 24 contact each other, and the cleaning blade 24 is set at the acute angle. In an illustrated example, the cleaning roller 15 is rotated in the counterclockwise direction, and the cleaning blade 24 is contacted to the cleaning roller 15 on a side upstream of a lowest point of the cleaning roller 15 with respect to the rotational direction d. For this reason, the cleaning blade 24 is positioned so that a contact position is in an upper end portion thereof with respect to a vertical direction, and is disposed so as to be inclined with respect to the vertical direction.

As described above, the liquid developer containing residual toner electrophoretically moved from the intermediary transfer belt 10 to the cleaning roller 15 is removed by the cleaning blade 24 and is moved along the surface of the cleaning blade 24 in a direction of gravitation.

The cleaning container 16 accommodates the cleaning roller 15 and the cleaning blade 24 and includes a bottom plate portion 25 below the cleaning roller 15 and the cleaning blade 24. Accordingly, the liquid developer removed by the cleaning blade 24 drops from the cleaning blade 24 onto the bottom plate portion 25 of the cleaning container 16. Further, the bottom plate portion 25 is formed so as to be capable of collecting also the liquid developer directly dropped from the cleaning roller 15.

The bottom plate portion 25 forms a collection path for permitting collection of the dropped liquid developer and is formed so that the liquid developer is collected at a discharge opening 26 formed in the cleaning container 16. In this embodiment, the discharge opening 26 is formed at a substantially center portion of the cleaning container 16 and in a lower end position of a side plate portion on one end side with respect to an axial direction of the cleaning roller 15 in a cross-section perpendicular to the axial direction of the cleaning roller 15.

Accordingly, the bottom plate portion 25 is provided with a slope from an end portion of the bottom plate portion 25 to the substantially center portion so that the substantially center portion in the above-described cross-section is lowest and is provided with the slope so that one end side, with respect to the axial direction of the cleaning roller 15, where the discharge opening 26 is formed is lowest. Further, the liquid developer dropped on the bottom plate portion 25 is discharged through the discharge opening 26. The discharge opening 26 is connected to an unshown developer collecting container, and the liquid developer discharged through the discharge opening 26 is stored in the developer collecting container.

Incidentally, in this embodiment, the discharge opening 26 is provided on a rear (surface) side of the image forming apparatus 100. Here, a front (surface) side of the image forming apparatus 100 is a side where a user or the like person operates the image forming apparatus 100, and for example, a side where an operating portion such as an operating panel is provided. Further, the rear side is a side opposite from this front side and is the above-described one end side with respect to the axial direction of the cleaning roller 15.

[Supporting Voltage]

Next, as regards the supporting unit 104, description will be made using parts (a) and (b) of FIG. 3 and parts (a) to (c) of FIG. 4. The supporting unit 104 as a holding member is capable of holding the transfer unit 102 at a first position where the liquid developer is capable of being transferred from the photosensitive drum 3 onto the intermediary transfer belt 10 as described above. At the first position, axial directions of the rollers of the transfer unit 102, such as the stretching rollers 10*a* and 10*b*, the secondary transfer inner roller 12*a*, the respective primary transfer rollers 11 and the like are substantially horizontal to a horizontal direction.

The transfer unit 102 includes, as described above, the intermediary transfer belt 10 stretched by the stretching rollers 10*a* and 10*b* and the secondary transfer inner roller 12*a*. Further, the transfer unit 102 includes a pair of supporting frames 200*a* and 200*b* provided on both sides with respect to a widthwise direction crossing the rotational direction of the intermediary transfer belt 10. In this embodiment, the widthwise direction is the same direction as the axial directions of the stretching rollers 10*a* and 10*b* and the secondary transfer inner roller 12*a*. Both end portions of the stretching rollers 10*a* and 10*b*, the secondary transfer inner roller 12*a* and the respective primary transfer rollers 11 are supported rotatably by the pair of supporting frames 200*a* and 200*b*.

Such a transfer unit 102 is configured so that the transfer unit 102 cannot be pulled out from a casing 110 of the image forming apparatus 100, in order to perform a maintenance operation such as an exchange of the intermediary transfer belt 10. Further, the transfer unit 102 is held by the supporting unit 104 so as to be capable of being inclined in an arrow f direction of part (b) of FIG. 3 in a state of being pulled out from the casing 110. Further, the supporting unit 104 is capable of being pulled out toward the front side of the image forming apparatus 100 relative to the casing 110 and is capable of being inclined into the casing 110. For this reason, the supporting unit 104 is held by a slide rail 27 provided in the casing 110 and is capable of being inclined and pulled out along the slide rail 27.

The supporting unit 104 includes a front side supporting portion 210*a* on the front side (downstream side with respect to a pulling-out direction) of the image forming apparatus 100 and includes a rear side supporting portion 210*b* on the rear side (upstream side with respect to the pulling-out direction) of the image forming apparatus 100. The front side supporting portion 210*a* and the rear side supporting portion 210*b* are connected by connecting portions 211 at opposite end portions with respect to a direction crossing the pulling-out direction. The transfer unit 102 is disposed in a space enclosed by such front side supporting portion 210*a*, rear side supporting portion 210*b* and pair of connecting portions 211.

During maintenance of the transfer unit 102, the supporting unit 104 holding the transfer unit 102 is pulled out of the casing 110 as shown in part (a) of FIG. 3. Then, as shown in part (b) of FIG. 3, the transfer unit 102 is inclined relative to the supporting unit 104 in an arrow f direction from a first position to a second position. That is, the transfer unit 102 is, as shown in part (a) of FIG. 3, supported relative to the supporting unit 104 by hinges 28 rotatably about one end side (rear side, upstream side with respect to the pulling-out direction), as a center, with respect to the widthwise direction of the intermediary transfer belt 10. Then, as shown in part (b) of FIG. 3, the other side (front side, downstream side with respect to the pulling-out direction) with respect to the widthwise direction of the intermediary transfer belt 10 is capable of being inclined to the second position where the other side is exposed to above the front side supporting portion 210*a* of the supporting unit 104.

In a state in which the transfer unit 102 is inclined to the second position, for example, by loosening tension applied to the intermediary transfer belt 10, it is possible to pull out the intermediary transfer belt 10 from the other side with respect to the widthwise direction. For this reason, a maintenance operation such as an exchange operation of the intermediary transfer belt 10 can be easily performed. For example, in the case where in a constitution in which the transfer unit 102 is held in the supporting unit 104 as in this embodiment, exchange or the like of the intermediary transfer belt 10 is carried out in the case where a constitution of inclining the transfer unit 102 is not employed, first, an operation of dismounting the front side supporting portion 210*a* or the like operation is needed. Then, after the intermediary transfer belt 10 is exchanged, an operation of assembling the front side supporting portion 210*a* is needed. On the other hand, as described above, when the transfer unit 102 is inclined, an operation such as the exchange of the intermediary transfer belt 10 can be performed without carrying out such dismounting and assembling operations of the front side supporting portion 210*a*, so that the maintenance operation can be easily performed.

In this embodiment, in order to cause the transfer unit 102 to be capable of being inclined as described above, damper-incorporated hinges 28 are provided between the supporting frame 200*b* on one end side with respect to the widthwise direction of the intermediary transfer belt 10 and the rear side supporting portion 210*b* of the supporting unit 104. Further, the transfer unit 102 includes projections 201 provided on the pair of supporting frames 200*a* and 200*b* so as to project in the widthwise direction. In part (a) of FIG. 4, a view of the front side supporting portion 200*a* as seen from the front side is shown. The projections 201 are provided at two positions spaced from each other at the same height position on a side surface the supporting frame 200*a* on the front side. The projections of the rear side supporting frame 200*b* are also similar to those of the front side supporting frame 200*a*.

Figure 4:
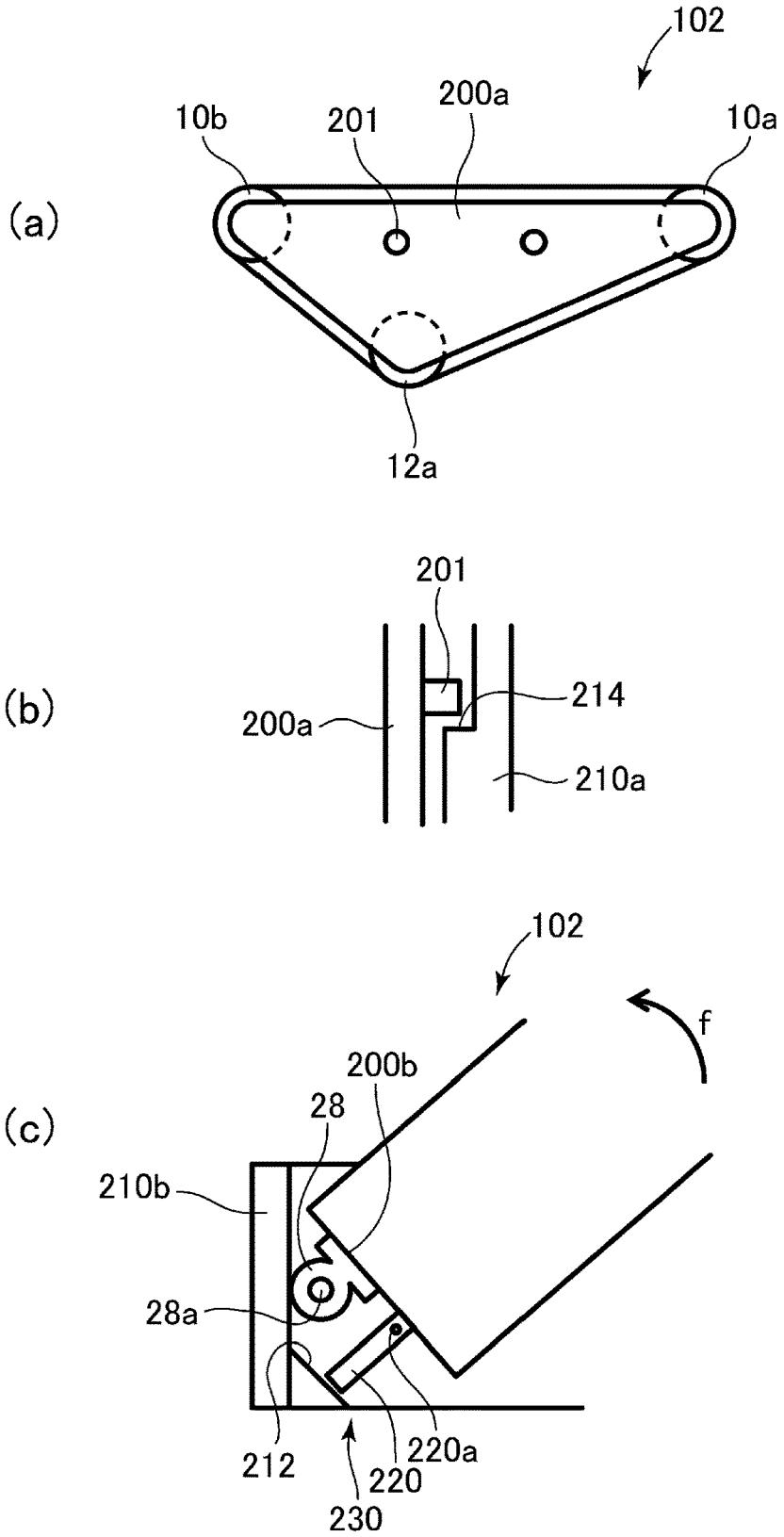
In FIG. 4, part (a) is a schematic structural side view of a transfer unit according to the first embodiment, part (b) is a sectional view of a portion for supporting the transfer unit according to the first embodiment relative to the supporting unit, and part (c) is sectional view of a portion for rotating and holding the transfer unit according to the first embodiment.

On the other hand, the supporting unit 104 includes, as shown in part (b) of FIG. 4, mounting portions 214 capable of mounting the projections 201 thereon at positions in alignment with the above-described projections 201 of the front side supporting portion 210*a* and the rear side supporting portion 210*b*. Further, by mounting the respective projections 201 of the supporting frames 200*a* and 200*b* on the mounting portions 214, respectively, the transfer unit 102 is supported at the first position by the supporting unit 104.

Further, by mounting the respective projections 201 of the supporting frames 200*a* and 200*b* on the mounting portions 214, respectively, so that the transfer unit 102 is supported at the first position by the supporting unit 104.

Further, as shown in part (c) of FIG. 4, to the rear side supporting frame 200*b* of the transfer unit 102, the hinges 28 supported rotatably in the arrow f direction about a rotation shaft 28*a* relative to the rear side supporting portion 210*b* are fixed. In the hinges 28, dampers are incorporated and are configured to attenuate a moving speed of the transfer unit 102 when the transfer unit 102 moves from the inclined state in a direction toward the first position by gravitation.

Further, by the supporting frame 200*b*, a lock arm 220 is supported rotatably about a rotation shaft 220*a* so as to project toward the rear side. The lock arm 220 rotates with the operation in which the transfer unit 102 is inclined and runs up onto an inclined surface of a stopper 212 provided on the supporting unit 104, and holds the transfer unit 102 at the second position. In this embodiment, a rotation holding portion 230 capable of holding the transfer unit 102 at the second position is constituted by such hinges 28, lock arm 220 and stopper 212. Incidentally, a constitution in which the transfer unit 102 is inclined and held at an inclined position as described above is similar to the above-described first embodiment.

[Transfer Cleaning Portion Supporting Structure]

Next, a supporting structure for the transfer cleaning portion 103 will be described using FIG. 5. In the case of this embodiment, the transfer cleaning portion 103 is supported by the supporting unit 104 irrespective of the rotation of the transfer unit 102 as described above. That is, the cleaning container 16 is supported by the supporting unit 104, and the cleaning roller 15 is rotatably supported, at opposite end portions with respect to the axial direction, by supporting wall portions 213 fixed to the supporting unit 104 via bearings 30 as holding side supporting portions. The cleaning blade 24 (see FIG. 2) is also supported by the supporting unit 104.

The cleaning roller 15 includes a roller portion 29*a* as a contact portion and shaft portions 29*b* provided at opposite end portions of the roller portion 29*a* with respect to the axial direction. The roller portion 29*a* contacts the intermediary transfer belt 10. The shaft portions 29*b* are rotatably supported by the rollers 30. In this embodiment, the cleaning roller 15 includes flanges 31 as restricting portions, each between the roller portion 29*a* and the bearing 30 on associated one of the opposite sides with respect to the axial direction, for restricting that the liquid developer reaches the bearing 30 from the roller portion 29*a*.

The flange 31 is provided on the shaft portion 29*b*, further on a roller portion 29*a* side than the bearing 30 is, so as to project from an outer peripheral surface of the shaft portion 29*b* in a radial direction. The flange 31 may also be provided integrally with the shaft portion 29*b*, and separately, may also be provided by fixing a flange member to the shaft portion 29*b* by press fitting or the like. In either case, the flange 31 restricts that the liquid developer flows along the shaft portion 29*b* from the roller portion 29*a* and reaches the bearing 30.

As described above, the transfer unit 102 is inclined relative to the supporting unit 104. Here, the liquid developer deposits on the intermediary transfer belt 10 of the transfer unit 102 and on the cleaning roller 15 and the cleaning blade 24 of the transfer cleaning portion 103. Further, in the cleaning container 16, the case where the collected liquid developer accumulates also exists. Accordingly, in the case where the transfer cleaning portion 103 is supported by the supporting unit 104 so as to be inclined together with the supporting unit 104, during inclination, for example, there is a liability that the liquid developer leaks out of the cleaning container 16. Further, there is a liability that the liquid developer deposited on the cleaning roller 15 and the cleaning blade 24 flows along surfaces of these members and drop onto portions other than the cleaning container 16 during the inclination.

On the other hand, in this embodiment, the transfer cleaning portion 103 is supported by and fixed to the supporting unit 104 irrespective of the rotation of the transfer unit 102. For this reason, even when the transfer unit 102 is inclined relative to the supporting unit 104 as described above during the maintenance, the transfer cleaning portion 103 is not inclined. For this reason, in order to prevent the leakage of the liquid developer from the transfer cleaning portion 103 during the inclination of the transfer unit 102, even when a constitution such that the leakage is prevented is not prevented separately, it is possible to suppress the leakage of the liquid developer out of the cleaning container 16 or the like.

Further, the cleaning roller 15 and the cleaning blade 24 are supported by the supporting unit 104 even when the transfer unit 102 is inclined. For this reason, similarly as when the transfer unit 102 is not inclined, the liquid developer deposited on the cleaning roller 15 and the cleaning blade 24 drops into the transfer cleaning portion 103. Accordingly, during the inclination of the transfer unit 102, it is possible to suppress the drop of the liquid developer from the cleaning roller 15 or the like onto a portion other than the cleaning container 16.

Figure 5:
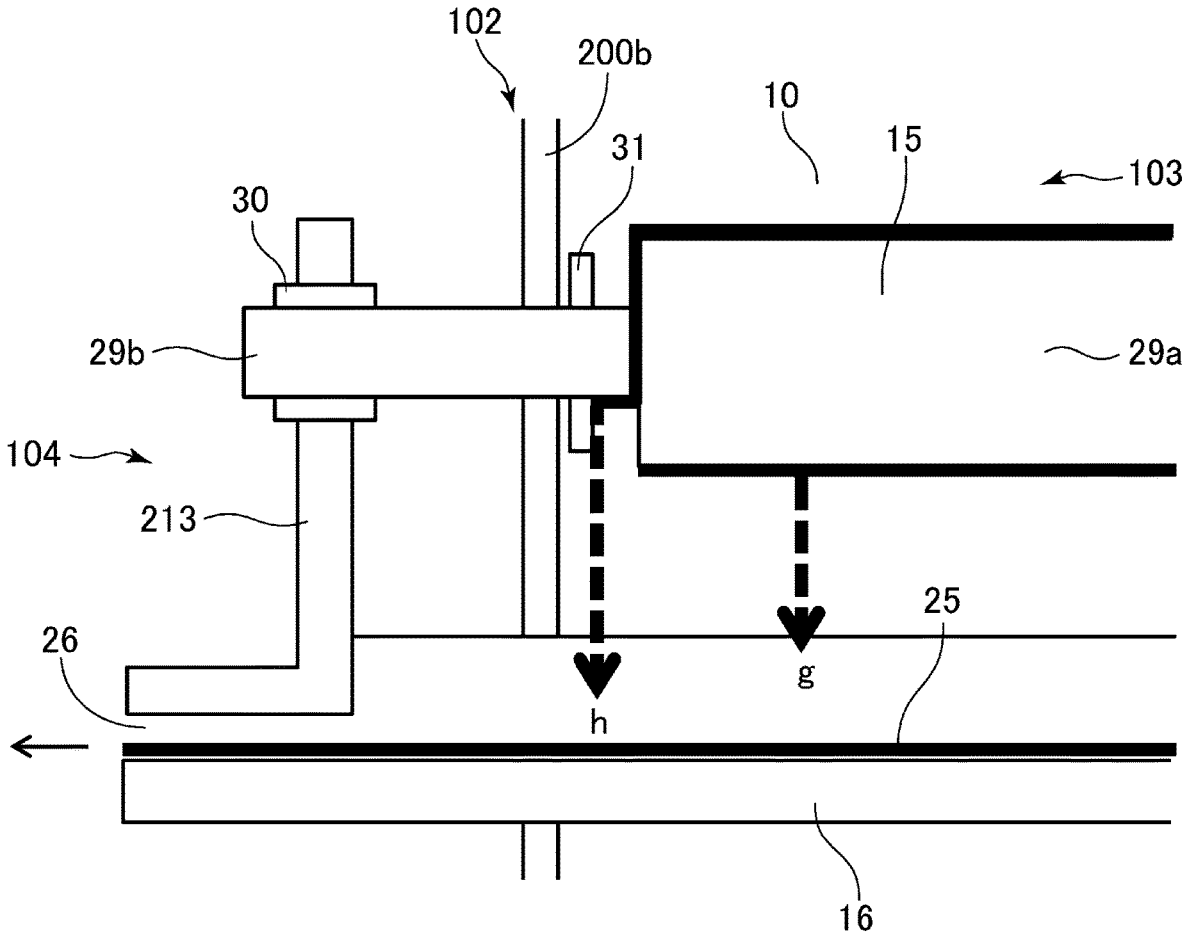
FIG. 5 is a sectional view showing a schematic structure of a transfer cleaning portion according to the first embodiment on an end portion side.

Description will be specifically made using FIG. 5. During image formation, the liquid developer is collected from the intermediary transfer belt 10 by the cleaning roller 15 and is deposited on the surface of the cleaning roller 15. The liquid developer deposited on the surface of the cleaning roller 15 is scraped off by the cleaning blade 24 and is collected in the cleaning container 16 as shown by an arrow g of FIG. 5.

Further, in the case where the transfer unit 102 is inclined relative to the supporting unit 104, the transfer cleaning portion 103 is not inclined together with the transfer unit 102, but is supported by the supporting unit 104. Accordingly, attitudes of the cleaning roller 15 and the cleaning container 16 are unchanged from those during the image formation. For this reason, as shown by the arrow g of FIG. 5, the liquid developer deposited on the surface of the cleaning roller 15 drops into the cleaning container 16 by gravitation.

Here, even when the transfer cleaning portion 103 is not inclined, a part of the liquid developer deposited on the surface of the cleaning roller 15 flows in the axial direction of the roller along the surface of the roller in some cases. Thus, the liquid developer flowing in the axial direction moves from the roller portion 29*a* toward the bearing 30 along the shaft portion 29*b*. If the liquid developer enters the bearing 30, the liquid developer contains the toner and has viscosity, so that there is a possibility that rotation accuracy of the bearing 30 lowers and a driving load increases. Further, there is also a possibility that the liquid developer passes through the bearing 30 and leaks to an outside of the cleaning container 16.

On the other hand, in the case of this embodiment, on the shaft portion 29*b* between the roller portion 29*a* and the bearing 30, the flange 31 with no through hole is provided. For this reason, the liquid developer flowing in the axial direction as described above is blocked by the flange 31 as shown by an arrow h and drops into the cleaning container 16 by gravitation, so that it is possible to suppress that the liquid developer reaches the bearing 30.

The liquid developer dropped in the cleaning container 16 as shown by the arrows g and h flows toward the discharge opening 26 along the surface of the bottom plate portion 25. Then, the liquid developer discharged through the discharge opening 26 is stored in an unshown developer collecting container.

Thus, in the case of this embodiment, the transfer cleaning portion 103 is supported by the supporting unit 104. For this reason, the transfer unit 102 can be inclined without inclining the transfer cleaning portion 103. For this reason, it is possible to suppress the leakage of the liquid developer capable of occurring by the inclination of the cleaning roller 15. Further, the flange 31 is provided between the roller portion 29*a* and the bearing 30 of the cleaning roller 15, and therefore, it is possible to suppress that the liquid developer flowing along the surface of the cleaning roller 15 in the axial direction reaches the bearing 30.

Second Embodiment

Figure 6:
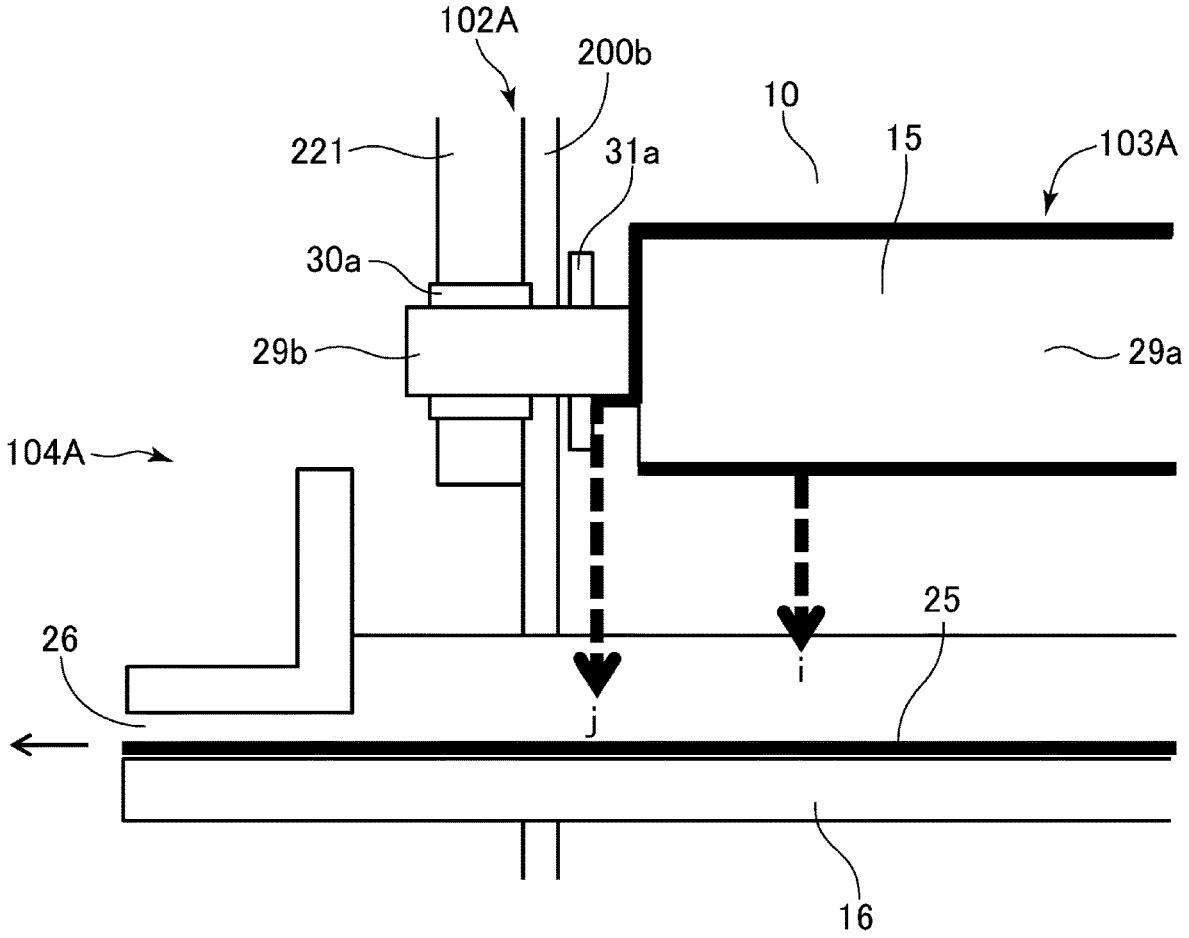
FIG. 6 is a sectional view showing a schematic structure of a transfer cleaning portion on an end portion side during a horizontal state of a transfer unit according to a second embodiment.

A second embodiment will be described using FIG. 6 and FIG. 7. In the above-described first embodiment, the constitution in which entirety of the transfer cleaning portion 103 is supported by the supporting unit 104 was described. On the other hand, in this embodiment, a cleaning container 16 of a transfer cleaning portion 103A is supported by a supporting unit 104A. Other constitutions and actions are similar to those in the above-described first embodiment, and therefore, as regards a redundant portion, the drawing and description will be omitted or briefly made, and the same reference numerals or symbols are added to the same constituent elements, and in the following, a portion different from the first embodiment will be principally described.

In this embodiment, the cleaning container 16 is supported by the supporting unit 104A, but the cleaning roller 15 and the cleaning blade 24 (see FIG. 2) are supported by a transfer unit 102A. Accordingly, the cleaning roller 15 and the cleaning blade 24 rotate together with the transfer unit 102A during maintenance.

For this reason, the cleaning roller 15 is rotatably supported, at opposite end portions with respect to the axial direction, by supporting wall portions 221 fixed to a pair of supporting frames 200*a* (see part (a) of FIG. 4) and 200*b*, respectively, of the transfer unit 102A, via bearings 30*a* as unit side supporting portions. The cleaning blade 24 (see FIG. 2) is also supported by the transfer unit 102. Further, the cleaning roller 15 includes flanges 31*a* as restricting portions, each between the roller portion 29*a* and the bearing 30*a* on associated one of the opposite sides with respect to the axial direction, for restricting that the liquid developer reaches the bearing 30 from the roller portion 29*a*.

Thus, by supporting the cleaning roller 15 on the transfer unit 102A side, a deviation of alignment between the cleaning roller 15 and the intermediary transfer belt 10 is made small. Further, the cleaning roller 15 decreases an influence on a feeding property of the intermediary transfer belt 10. That is, the stretching rollers 10*a* and 10*b* and the secondary transfer inner roller 12*a* are supported by the pair of supporting frames 200*a* and 200*b*. Further, the cleaning roller 15 is supported via the bearings 30*a* by the supporting wall portions 221 fixed to the supporting frames 200*a* and 200*b*. For this reason, each of the stretching rollers 10*a* and 10*b*, the secondary transfer inner roller 12*a* and the cleaning roller 15 is supported by the supporting frames 200*a* and 200*b*, so that a deviation of alignment among the respective rollers can be made small.

In the case of this embodiment, the liquid developer is collected from the transfer cleaning portion 103A at a first position (during horizontality) and a second position (during inclination), respectively, in the following manner. First, in the case where the transfer unit 102A shown in FIG. 6 is in horizontality, the liquid developer which is collected from the intermediary transfer belt 10 and which is deposited on the surface of the cleaning roller 15 is scraped off by the cleaning blade 24 and is collected in the cleaning container 16 as shown by an arrow i of FIG. 6. Further, the liquid developer flowing along the surface of the cleaning roller 15 in the axial direction in this state is blocked by the flange 31*a* with no through hole as shown by an arrow j, and drops into the cleaning container 16 by gravitation. As a result, it is possible to suppress that the liquid developer reaches the bearing 30*a*.

Figure 7:
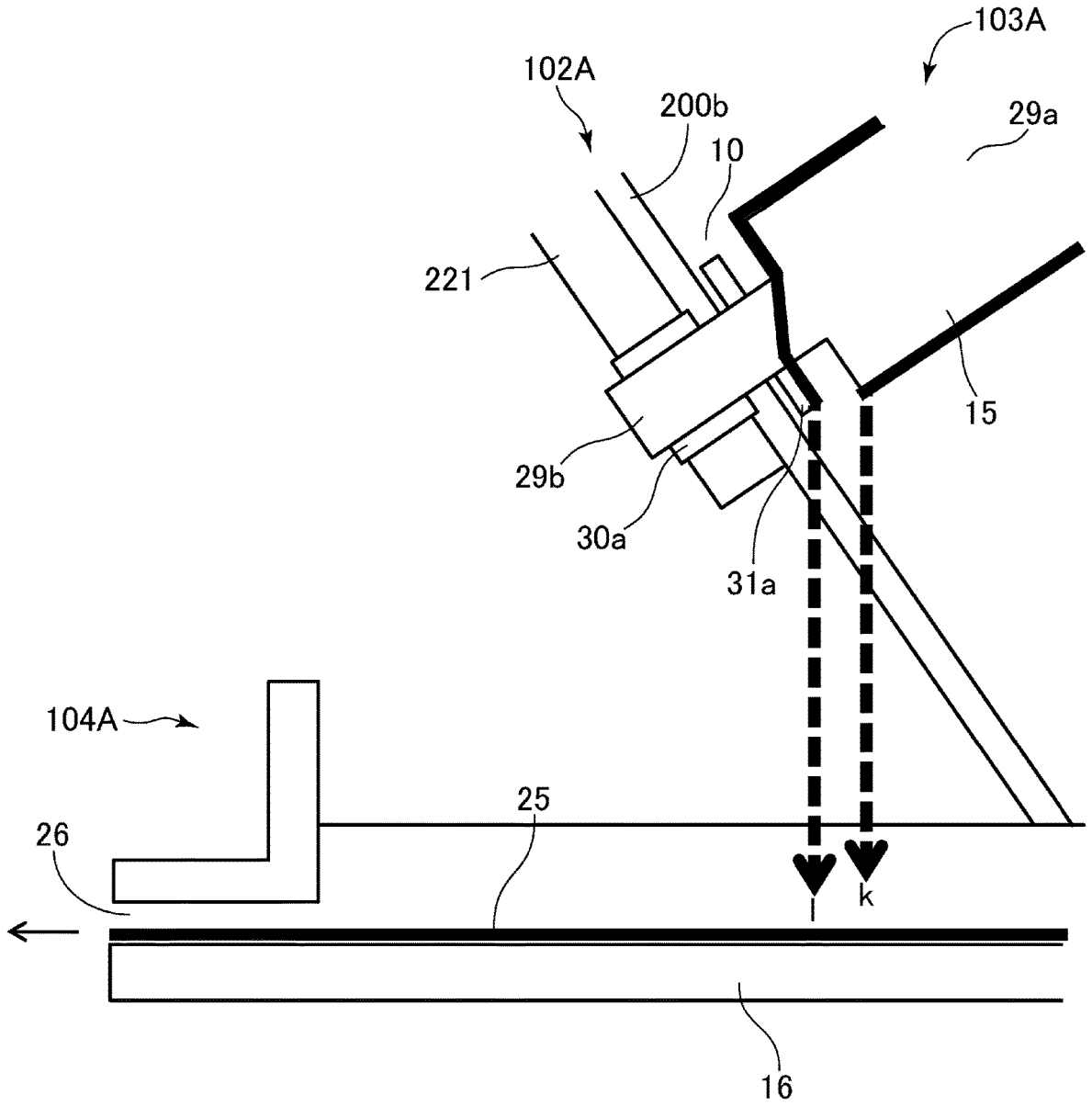
FIG. 7 is a sectional view showing a schematic structure of the transfer cleaning portion on the end portion side during inclination of the transfer unit according to the second embodiment.

Next, in the case where the transfer unit 102A shown in FIG. 7 is in inclination, the cleaning roller 15 is inclined in a state in which an image forming operation is stopped. For this reason, the liquid developer on the surface of the cleaning roller 15 flows along the direction of gravitation and drops from a lowest portion of the roller portion 29*a*, and is collected in the cleaning container 16 as shown by an arrow k. On the other hand, the liquid developer flowing from an upper portion of the cleaning roller 15 flows along the shaft portion 29*b* toward the bearing 30*a* in some instances before the liquid developer reaches the lowest portion of the roller portion 29*a*. However, even in this case, the flange 31*a* is provided on the shaft portion 29*b* between the roller portion 29*a* and the bearing 30*a*, and therefore, the liquid developer flowed as described above is blocked by the flange 31*a* as shown by an arrow 1, and drops into the cleaning container 16 by gravitation. Accordingly, it is possible to suppress that the liquid developer reaches the bearing 30*a*.

The liquid developer dropped in the cleaning container 16 as shown by the arrows k and 1 flows toward the discharge opening 26 along the surface of the bottom plate portion 25. Then, the liquid developer discharged through the discharge opening 26 is stored in an unshown developer collecting container.

Thus, in the case of this embodiment, the cleaning container 16 is supported by the supporting unit 104A, and therefore, it is possible to suppress the leakage of the liquid developer by a constitution in which the transfer unit 102A is inclined. Further, the flange 31*a* is provided between the roller portion 29*a* and the bearing 30*a* of the cleaning roller 15, and therefore, even when the cleaning roller 15 is inclined together with the transfer unit 102A, it is possible to suppress that the liquid developer reaches the bearing 30*a*. Incidentally, in order to suppress the leakage of the liquid developer when the transfer unit is inclined, the flange 31*a* is provided only on a rear side (rotation supporting side) with respect to the axial direction of the cleaning roller, and the flange may also be not provided on the front side. Further, as a matter of course, the flange 31*a* may also be provided on both sides of the cleaning roller.

Third Embodiment

A third embodiment will be described using FIG. 8 to FIG. 10. In the above-described first and second embodiments, the constitution relating to the transfer cleaning portion 103 was principally described. On the other hand, in the case of this embodiment, a constitution relating to the primary transfer roller 11 as a contact roller contacting an inner peripheral surface of the intermediary transfer belt 10 will be described. Other constitutions and actions are similar to those in the above-described first and second embodiments, and therefore, as regards a redundant portion, the drawing and description will be omitted or briefly made, and the same reference numerals or symbols are added to the same constituent elements, and in the following, a portion different from the first and second embodiments will be principally described.

To the primary transfer roller 11, as described above, in order to transfer the toner image on the photosensitive drum 3, onto the intermediary transfer belt 10 at the primary transfer portion T1, the voltage (primary transfer bias) is applied (see FIG. 1). Accordingly, the primary transfer roller 11 is energized from an energizing portion such as the toner source via the electrode member by being contacted to the electrode member. Here, when the liquid developer is deposited on a contact portion between the electrode member and the primary transfer roller 11, there is a liability that electrical conductive failure is caused to occur. This point will be described using a comparison example of FIG. 8.

Comparison Example

Figure 8:
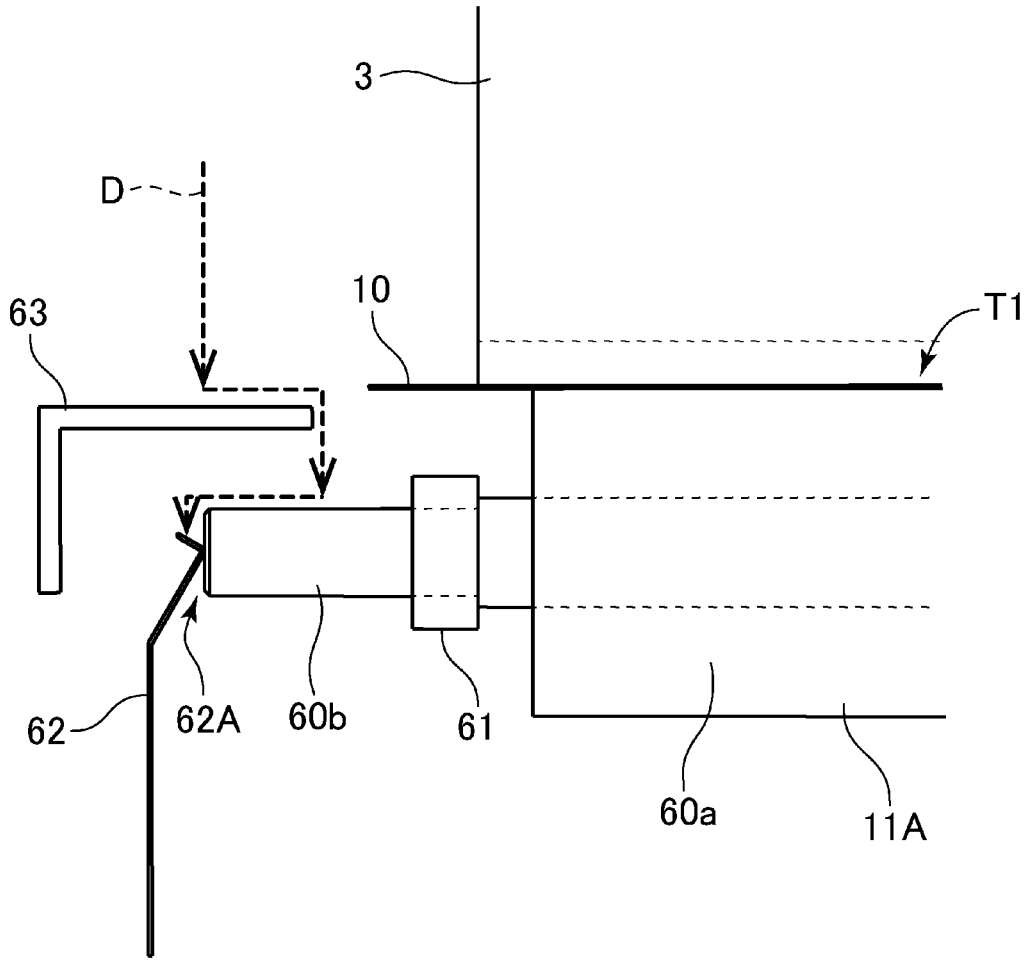
FIG. 8 is a side view showing a schematic structure of a primary transfer portion on an end portion side in a comparison example in a state in which an intermediary transfer belt is cut.

FIG. 8 is a view showing a constitution of the primary transfer portion T1 on an end portion side with respect to an axial direction of a primary transfer roller 11A in a constitution of the comparison example. The primary transfer roller 11A includes a contact roller portion 60*a* contacting the inner peripheral surface of the intermediary transfer belt 10 and an electroconductive shaft portion 60*b* which is provided at an end portion of the contact roller portion 60*a* and which is electroconductive. The electroconductive shaft portion 60*b* is supported by the supporting frames 200*a* and 200*b* (see parts (a) and (c) of FIG. 4) via bearings 61. Further, to an end portion of the electroconductive shaft portion 60*b*, an electrode member 62 connected to an unshown energizing portion is contacted. Further, the primary transfer roller 11A is supplied with a voltage from the energizing portion via the electrode member 62.

Here, in the case of using the liquid developer, there is a liability that the liquid developer drops from the image forming portion such as the photosensitive drum 3 positioned above the primary transfer roller 11A. Further, when the dropped liquid developer is deposited on an electrode contact portion 62A between the electrode member 62 and the electroconductive shaft portion 60*b*, there is a liability that improper electroconductivity is caused to occur. For this reason, in the comparison example of FIG. 8, a portion above the electrode outside portion 62A is covered with a cover member 63.

However, there is a liability that the liquid developer dropped on the cover member 63 drops from an end portion of the cover member 63 onto the electroconductive shaft portion 60*b* and reaches the electrode contact portion 62A along the electroconductive shaft portion 60*b*. Accordingly, even when the portion above the electrode contact portion 62A is simply covered with the cover member 63, arrival of the liquid developer at the electrode contact portion 62A cannot be prevented sufficiently.

Constitution of this Embodiment

Figure 9:
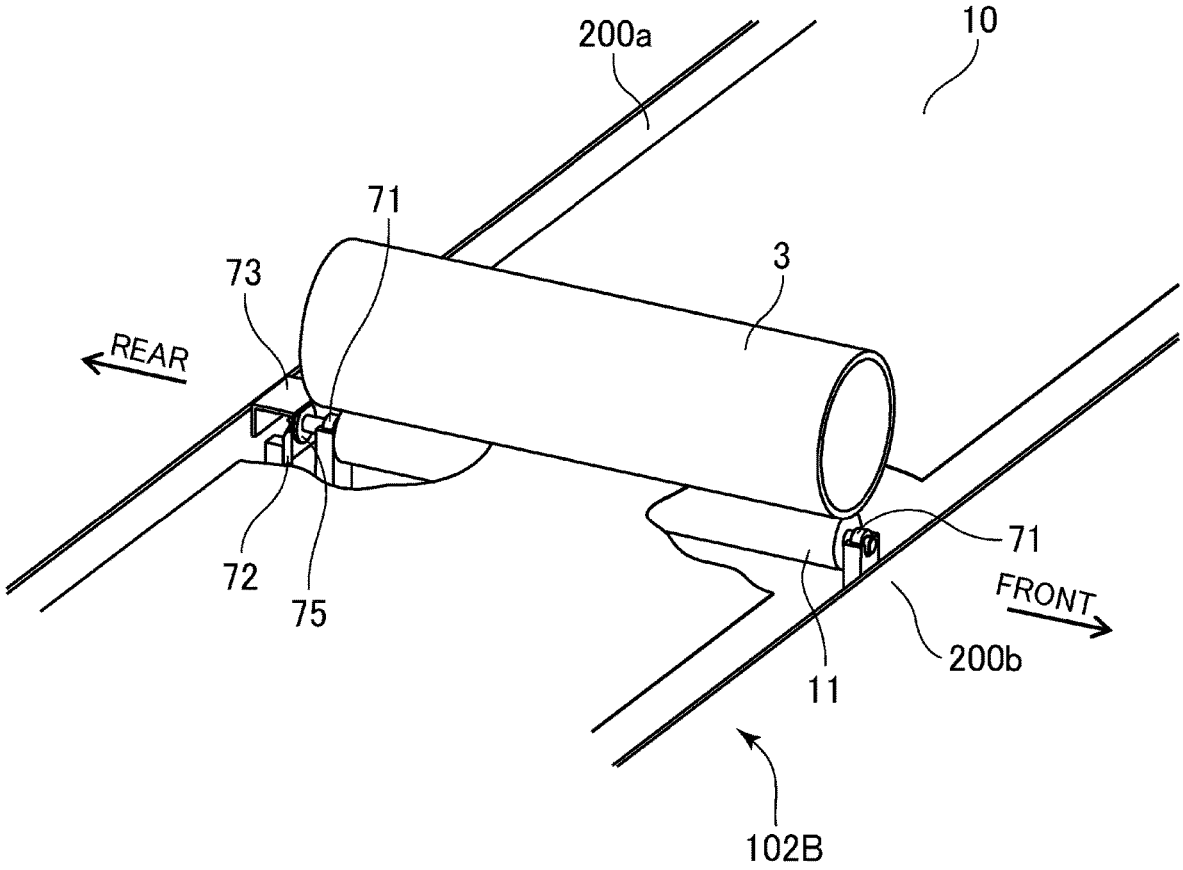
FIG. 9 is a perspective view showing a schematic structure of a primary transfer portion according to a third embodiment in a state in which a part of an intermediary transfer belt is cut.
Figure 10:
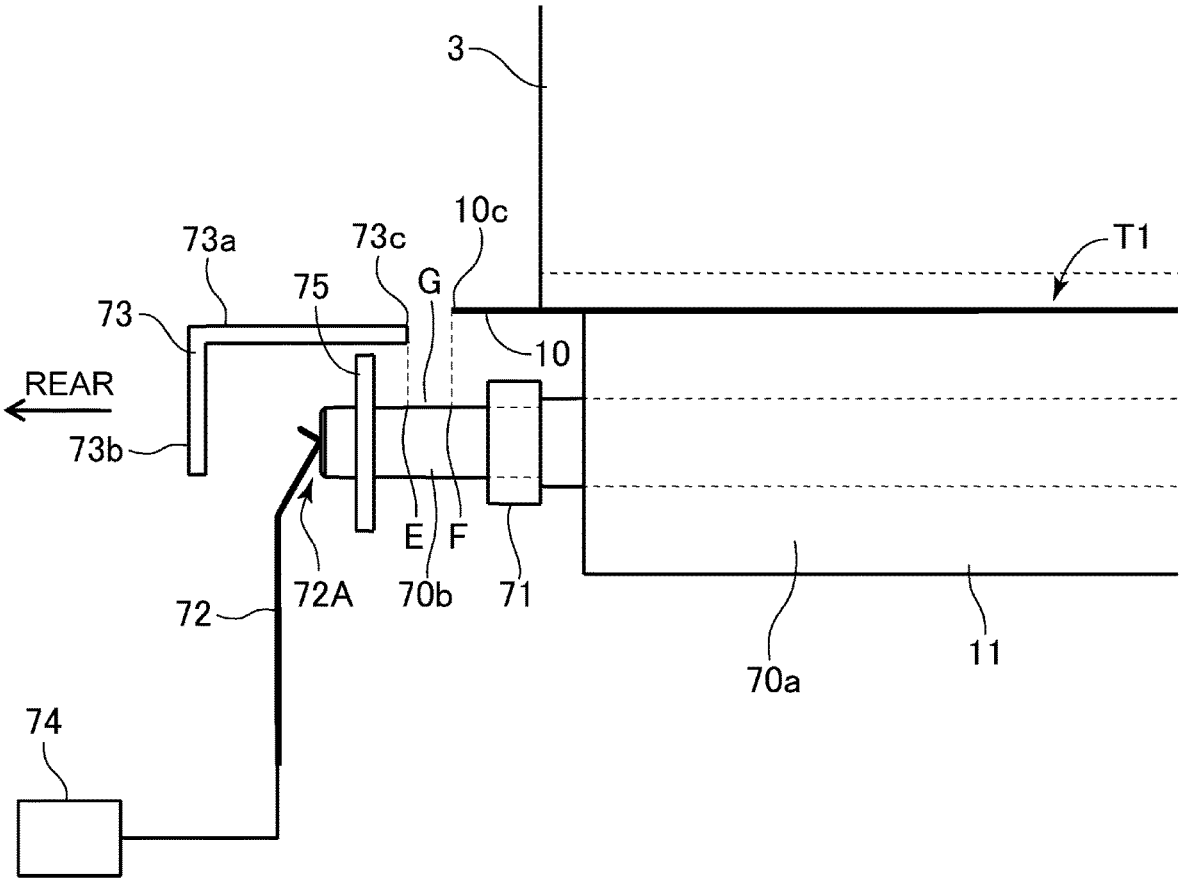
FIG. 10 is a side view showing a schematic structure of the primary transfer portion according to the third embodiment on an end portion side in a state in which the intermediary transfer belt is cut.

Therefore, in this embodiment, as shown in FIG. 9 and FIG. 10, a constitution in which the liquid developer does not readily reach the electrode contact portion is employed. As shown in FIG. 9, the primary transfer roller 11 is disposed so as to sandwich the intermediary transfer belt as the transfer member with the photosensitive drum 3. Opposite end portions of the primary transfer roller 11 are rotatably supported by a pair of supporting frames 200*a* and 200*b* constituting a transfer unit 102B, via bearings 71, respectively. Further, the primary transfer roller 11 is, for example, pressed toward the intermediary transfer belt 10 by urging the bearings 71 by unshown springs. Further, the primary transfer roller 11 is rotated by rotation of the intermediary transfer belt 10. In this embodiment, on the rear side (REAR) of the casing 110 (see parts (a) and (b) of FIG. 3) of the image forming apparatus, an electrode member 72 for energizing the primary transfer roller 11 is provided.

Description will be specifically described using FIG. 10. The primary transfer roller 11 as a contact roller includes a contact roller portion 70*a* contacting the inner peripheral surface of the intermediary transfer belt 10 and includes electroconductive shaft portions 70*b* which are provided at end portions of the contact roller portion 70*a* and which are electroconductive. Further, the electroconductive shaft portions 70*b* of opposite ends of the contact roller portion 70*a* are rotatably supported by bearings 71, respectively. An outer diameter of the electroconductive shaft portions 70*b* is constituted so as to be smaller than an outer diameter of the contact roller portion 70*a*. By doing so, a creepage distance between the photosensitive drum 3 and the primary transfer roller 11 can be ensured. FIG. 10 shows a structure of the casing 110 on a rear side. The intermediary transfer belt 10 projects at a widthwise end portion in the axial direction more than an end portion of the contact roller portion 70*a* with respect to the axial direction is. Accordingly, a rear side end portion 10*c* of the intermediary transfer belt 10 projects more than a rear side end portion of the contact roller portion 70*a* is, and in an illustrated example, a portion above the bearing 71 is covered by the projected portion of the intermediary transfer belt 10. For this reason, it is possible to prevent drop of the liquid developer directly on the bearing 71.

The rear side electroconductive shaft portion 70*b* is extended to a further rear side more than the rear side widthwise end portion 10*c* of the intermediary transfer belt 10 is, and to an end portion thereof, for example, an electrode member 72 as an electric contact portion formed by bending a metal plate having elasticity is elastically contacted. In this embodiment, a free end portion of the electrode member 72 contacts an end surface of the electroconductive shaft portion 70*b*. The electrode member 72 is connected to an energizing portion 74. Accordingly, the primary transfer roller 11 is supplied with a primary transfer bias (voltage) from the energizing portion 74 via the electrode member 72.

When the electrode member 72 is seen from the widthwise direction of the intermediary transfer belt 10, the electrode member 72 has a dimension such that the electrode member 72 is accommodated inside the intermediary transfer belt 10. In order to suppress leakage of a current to a periphery of the intermediary transfer belt 10, the end portion of the electrode member 72 is disposed so as not to be protruded to the outside of the intermediary transfer belt 10.

Further, also in the case of this embodiment, at least a portion above an electrode contact portion 72A where the electrode member 72 and the electroconductive shaft portion 70*b* contact each other is covered by a cover member 73. Further, direct drop of the liquid developer onto the electrode contact portion 72A from the image forming portion such as the photosensitive drum 3 positioned above the primary transfer roller 11 is prevented.

The cover member 73 is, for example, a plate-like member formed of a resin material. Such a cover member 73 includes a cover portion 73*a* covering the portion above the electrode contact portion 72A and a bent portion 73*b* obtained by bending a rear side end portion of the cover portion 73*a* downward. The rear side end portion of the cover portion 73*a* is positioned further on a rear side than the end portion of the electroconductive shaft portion 70*b* is. That is, cover member 73 covers a portion above the end portion of the electroconductive shaft portion 70*b* on a side opposite from the contact roller portion 70*a*. The bent portion 73*b* is extended so that a lower end thereof is positioned beyond the electrode contact portion 72A by bending a rear side end portion of the cover portion 73*a*. Accordingly, as seen from the axial direction, the electrode contact portion 72A is covered by the bent portion 73*b*.

In this embodiment, in addition to such a cover member 73, at an end portion of the primary transfer roller 11, a flange 75 as a restricting member for the cover member is provided. The flange 75 is provided, with respect to the axial direction of the primary transfer roller 11, between a front side end portion 73*c* of the cover member 73 and the electrode contact portion 72A, and restricts that the liquid developer reaches the electrode contact portion 72A from the end portion 73*c* of the cover member 73.

Particularly, in this embodiment, the electrode member is positioned on the rear side of the casing 110 where a rotation center of the transfer unit exists. For this reason, the flange 75 is positioned, with respect to the direction of gravitation, below the front side end portion 73*c* of the cover member 73 at the second position where the transfer unit is inclined during the maintenance or the like.

Such a flange 75 is provided on the electroconductive shaft portion 70*b* so as to project from the outer peripheral surface of the electroconductive shaft portion 70*b* in a radial direction. The flange 75 may be provided integrally with the electroconductive shaft portion 70*b*, and separately, may also be provided by fixing a flange member to the electroconductive shaft portion 70*b* by press-fitting. In either case, the flange 75 restricts, as described later, that the liquid developer flows along the electroconductive shaft portion 70*b* and reaches the electrode contact portion 72A.

The liquid developer dropped from the image forming portion such as the photosensitive drum 3 positioned above the primary transfer roller 11 drops into a region G between a position E of the electroconductive shaft portion 70*b* and a position F. The position E is a position below the end portion 73*c* of the cover member 73 with respect to the vertical direction, and the position F is a position below the rear side end portion 10*c*, with respect to the widthwise direction, of the intermediary transfer belt 10 with respect to the vertical direction. More specifically, the position F is the position below the rear side end portion 10*c*, with respect to the widthwise direction, of the intermediary transfer belt 10 with respect to the vertical direction when the intermediary transfer belt 10 shifts to a rearmost side during the image formation. Specifically, the liquid developer dropped on the cover member 73 flows along the cover member 73 and drops from the end portion 73*c* onto the position E of the electroconductive shaft portion 70*b*. Further, the liquid developer on the intermediary transfer belt 10 flows along the surface of the intermediary transfer belt 10 and drops from the end portion 10*c* onto the position F of the electroconductive shaft portion 70*b*. Further, the liquid developer also directly drops into the region G of the electroconductive shaft portion 70*b* without via the cover member 73 or the intermediary transfer belt 10 in some cases.

The liquid developer dropped in the region G in this manner moves in the axial direction along the surface of the electroconductive shaft portion 70*b* in some cases. However, in this embodiment, a flange 75 with no through hole is provided on the electroconductive shaft portion 70*b* between the region G and the electrode contact portion 72A. For this reason, the liquid developer flowing along the surface of the electroconductive shaft portion 70*b* is blocked by the flange 75 and drops downward by gravitation, so that it is possible to suppress that the liquid developer reaches the electrode contact portion 72A. Further, even in a state in which the transfer unit is inclined to the second position, similarly, the liquid developer flowing along the surface of the electroconductive shaft portion 70*b* is blocked by the flange 75 so that it is possible to suppress that the liquid developer reaches the electrode contact portion 72A.

Further, the liquid developer dropped on the cover member 73 also drops from the rear side end portion of the cover member 73. However, the rear side end portion of the cover member 73 is positioned on a rear side more than the electrode contact portion 72A is, and therefore, even when the liquid developer drops from the rear side end portion of the cover member 73, the liquid developer does not reach the electrode contact portion 72A. Further, the electrode contact portion 72A is covered by the bent portion 73*b* with respect to the axial direction, and therefore, it is possible to more reliably suppress that the liquid developer is deposited on the electrode contact portion 72A from the rear side.

Incidentally, the cover portion 73*a* of the cover member 73 at least may only be required to cover the portion above the electrode contact portion 72A, and the front side end portion 73*c* may only be required to be positioned on the front side more than the flange 75 is. However, the cover portion 73*a* may preferably cover above entirety of the flange 75. That is, when the flange 75 is seen from above, the entirety of the flange 75 may preferably be covered by the cover portion 73*a*.

By this, it is possible to suppress that the liquid developer dropped from a side end portion of the cover portion 73*a* is deposited on a rear side-side surface of the flange 75. If the liquid developer is deposited on the rear side-side surface of the flange 75, there is a possibility that the deposited liquid developer by rotation of the primary transfer roller 11 reaches the rear side further than the flange 75 is, and reaches the electrode contact portion 72A. On the other hand, when the cover portion 73*a* covers above the entirety of the flange 75, deposition of the liquid developer on the rear side-side surface of the flange 75 is suppressed, so that it is possible to suppress that the liquid developer reaches the electrode contact portion 72A.

Further, the cover portion 73*a* of the cover member 73 may preferably cover above the entirety of the electrode member 72.

Fourth Embodiment

A fourth embodiment will be described using parts (a) and (b) of FIG. 11. In the above-described third embodiment, the constitution in which the electrode member 72 is contacted to the end surface of the electroconductive shaft portion 70*b* was described. On the other hand, in this embodiment, an electrode member 720 is elastically contacted to a circumferential surface of the electroconductive shaft portion 70*b*. Other constitutions and actions are similar to those in the above-described third embodiment, and therefore, as regards a redundant portion, the drawing and description will be omitted or briefly made, and the same reference numerals or symbols are added to the same constituent elements, and in the following, a portion different from the third embodiment will be principally described.

Figure 11:
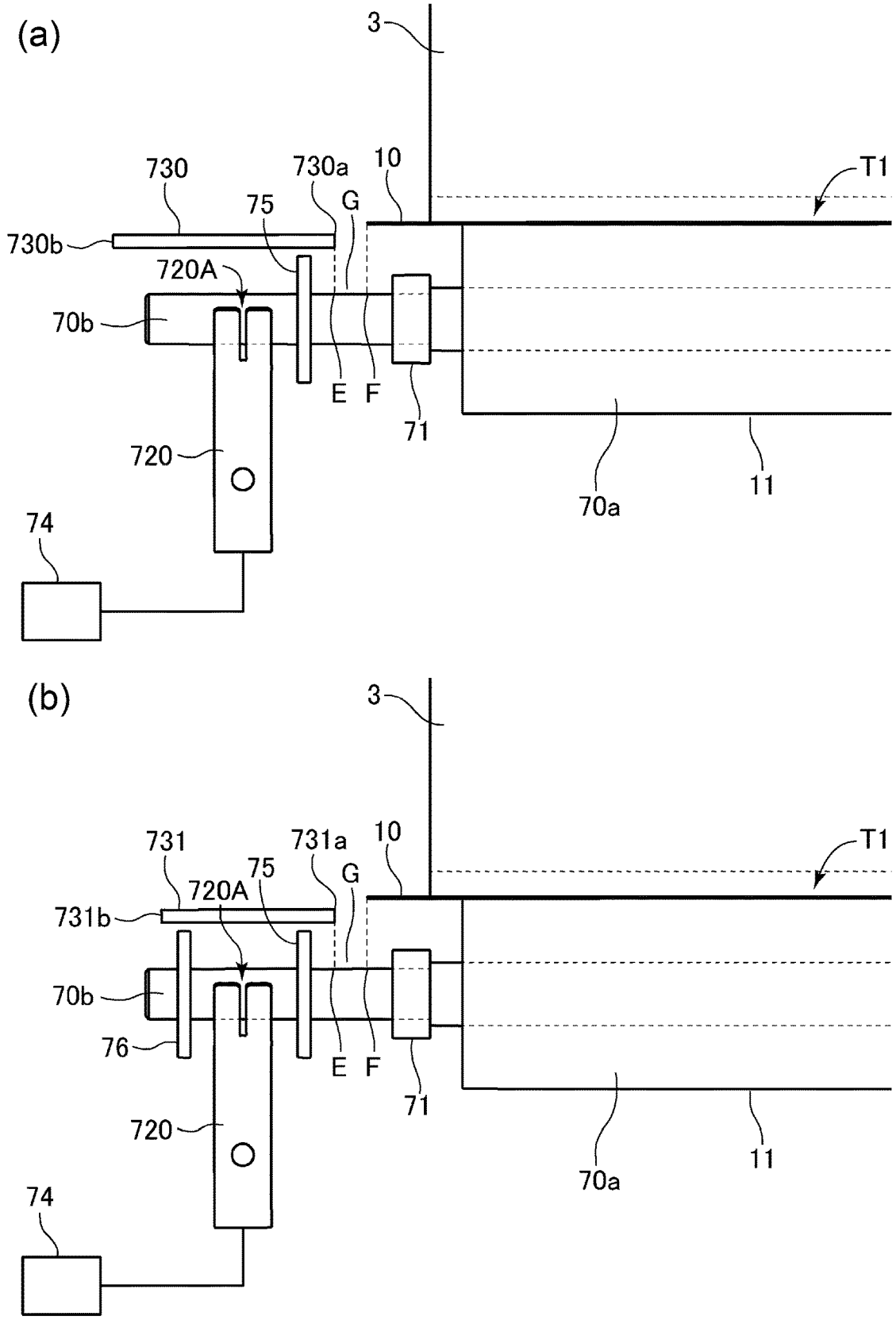
FIG. 11 includes side views each showing a schematic structure of a primary transfer portion according to a fourth embodiment on an end portion side in a state in which an intermediary transfer belt is cut, in which part (a) shows the primary transfer portion according to a first example, and part (b) shows the primary transfer portion according to a second example.

In part (a) of FIG. 11, a constitution of a first example of this embodiment is shown. In the case of this embodiment, a free end portion of the electrode member 720 is elastically contacted to the circumferential surface of the electroconductive shaft portion 70*b*. Further, a cover member 730 covers at least above an electrode contact portion 720A where the electrode member 720 and the electroconductive shaft portion 70*b* contact each other. Further, the flange 75 is provided between a front side end portion 730*a* of the cover member 730 and the electrode contact portion 720A with respect to the axial direction of the primary transfer roller 11. Further, the liquid developer is suppressed from reaching the electrode contact portion 720A from the cover member 730.

Incidentally, a rear side end portion 730*b* of the cover member 730 is positioned on a further rear side than a rear side end surface of the electroconductive shaft portion 70*b* is. However, in the case of the first example of this embodiment, on the rear side of the cover member 730, the bent portion as in the third embodiment is not provided.

Also in such a case of the first example of this embodiment, the liquid developer dropped in the region G and flowed in the axial direction along the surface of the electroconductive shaft portion 70*b* is blocked by the flange 75 and is dropped downward by gravitation, so that it is possible to suppress that the liquid developer reaches the electrode contact portion 720A.

Further, the rear side end portion 730*b* of the cover member 730 is positioned further on the rear side than the end surface of the electroconductive shaft portion 70*b* is, and therefore, even when the liquid developer drops from the rear side end portion of the cover member 730, deposition of the liquid developer onto the electroconductive shaft portion 70*b* can be suppressed. If the liquid developer deposits on the electroconductive shaft portion 70*b* on the rear side of the electrode contact portion 720A, the liquid developer flows in the axial direction also from this rear side in some cases. In the first example of this embodiment, also the portion above the rear side end surface of the electroconductive shaft portion 70*b* is covered by the cover member 730, and therefore, it is possible to thus suppress that the liquid developer reaches the electrode contact portion 720A from the rear side.

On the other hand, in a second example of this embodiment shown in part (b) of FIG. 11, a rear side end portion 731*b* of a cover member 731 covering a portion above the electrode contact portion 720A is positioned further on a front side than an end surface of the electroconductive shaft portion 70*b* is. In the case of such a constitution, in addition to a front side flange 75 of the electrode contact portion 720A, a flange 76 similar to the flange 75 is provided on the electroconductive shaft portion 70*b* on the rear side of the electrode contact portion 720A. That is, with respect to the axial direction of the primary transfer roller 11, the flange 76 is provided between the rear side end portion 731*b* of the cover member 731 and the electrode contact portion 720A. The flange 75 is, similar to the first example of this embodiment, provided between a front side end portion 731*a* of the cover member 731 and the electrode contact portion 720A.

In such a case of the second example of this embodiment, the liquid developer dropped from the rear side end portion 731*b* of the cover member 731 and flowed in the axial direction along the surface of the electroconductive shaft portion 70*b* is blocked by the flange 76 and drops downward by gravitation. As a result of this, it is possible to suppress that the liquid developer reaches the electrode contact portion 720A from the rear side.

Fifth Embodiment

A fifth embodiment will be described using parts (a) and (b) of FIG. 12. In the above-described fourth embodiment, the constitution in which the electrode member 72 is contacted to the end surface of the electroconductive shaft portion 70*b* was described. On the other hand, in this embodiment, in such a constitution, entrance and deposition of the liquid developer onto bearings and gears can be suppressed. Other constitutions and actions are similar to those in the above-described fourth embodiment, and therefore, as regards a redundant portion, the drawing and description will be omitted or briefly made, and the same reference numerals or symbols are added to the same constituent elements, and in the following, a portion different from the fourth embodiment will be principally described.

Figure 12:
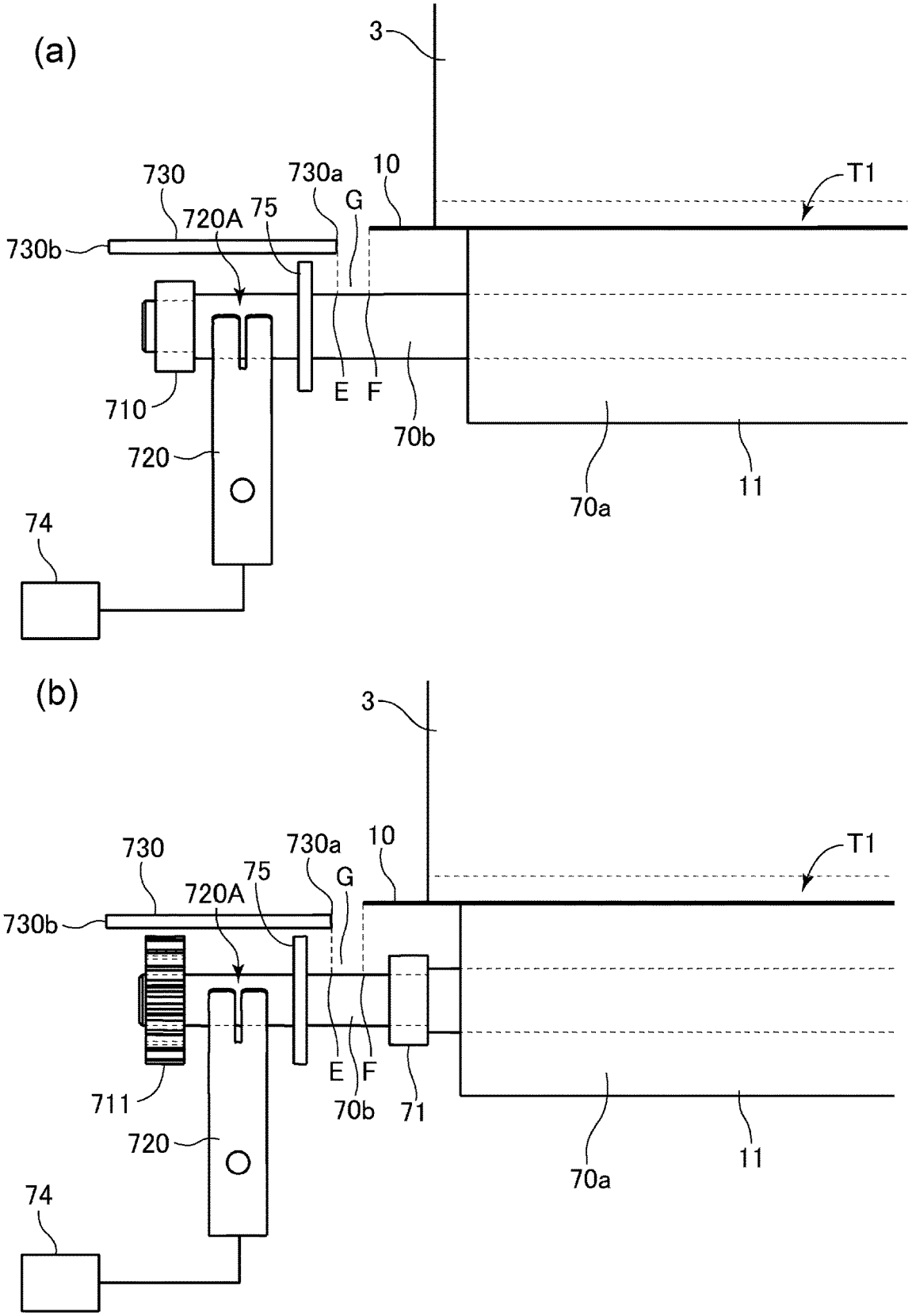
FIG. 12 includes side views each showing a schematic structure of a primary transfer portion according to a fifth embodiment on an end portion side in a state in which an intermediary transfer belt is cut, in which part (a) shows the primary transfer portion according to a first example, and part (b) shows the primary transfer portion according to a second example.

As shown in part (a) of FIG. 12, in a first example of this embodiment, a bearing 710 supports the electroconductive shaft portion 70*b* on a side opposite from the front side end portion 730*a* of the cover member 730 while sandwiching the flange 75 between itself and the front side end portion 730*a* with respect to the axial direction of the primary transfer roller 11. Further, the cover member 730 also covers a portion above the bearing 710. Incidentally, also in the case of this embodiment, the rear side end portion 730*b* of the cover member 730 projects further toward a rear side than a rear side end surface of the electroconductive shaft portion 70*b* projects.

In such a case of this embodiment, the liquid developer dropped in the region G and flowed in the axial direction along the surface of the electroconductive shaft portion 70*b* is blocked by the flange 75 and is dropped downward by gravitation, so that it is possible to suppress that the liquid developer reaches the electrode contact portion 720A and the bearing 710. Further, the bearing 710 is covered by the cover member 730 at a portion above the bearing 710. For this reason, it is possible to suppress that the liquid developer enters the bearing 710.

On the other hand, in a second example of this embodiment shown in part (b) of FIG. 12, a gear 711 is provided on the electroconductive shaft portion 70*b* on a side opposite from the front side end portion 730*a* of the cover member 730 while sandwiching the flange 75 between itself and the front side end portion 730*a* with respect to the axial direction of the primary transfer roller 11. Further, the cover member 730 also covers a portion above the bearing 710. Incidentally, also in the case of this embodiment, the rear side end portion 730*b* of the cover member 730 projects further toward a rear side than a rear side end surface of the electroconductive shaft portion 70*b* projects.

The gear 711 is connected to a drive transmitting portion to which rotational drive from an unshown driving source such as a motor is transmitted. When the liquid developer enters or deposits on the drive transmitting portion including the gear 711 via such a gear 711, there is a possibility that an improper operation is caused. For this reason, by disposing the gear 711 as in this embodiment, entrance or deposition of the liquid developer onto the gear 711 is suppressed.

That is, the liquid developer dropped in the region G and flowed in the axial direction along the surface of the electroconductive shaft portion 70*b* is blocked by the flange 75 and is dropped downward by gravitation, so that it is possible to suppress that the liquid developer reaches the gear 711. Further, the gear 711 is covered by the cover member 730 at a portion above the gear 711. For this reason, it is possible to suppress that the liquid developer enters or deposits onto the drive transmitting portion including the gear 711, via the gear 711. Incidentally, the rotation transmitting member may also be, for example, a pulley other than the gear.

Incidentally, a positional relationship between the gear or the rotation transmitting member and the electrode contact portion with respect to the axial direction may also be opposite to those of parts (a) and (b) of FIG. 12. Further, in this embodiment, the bearing 71 is disposed inside the flange 75 with respect to the axial direction, but may also be disposed outside the flange 75.

Sixth Embodiment

A sixth embodiment will be described using parts (a) and (b) of FIG. 13. In the above-described third embodiment, the constitution in which the cover member 73 and the intermediary transfer belt 10 do not overlap with each other was described. On the other hand, in this embodiment, a cover member 732 and the intermediary transfer belt 10 are caused to partially overlap with each other. Further, the bearing 710 is disposed below the cover member 732. Other constitutions and actions are similar to those in the above-described third embodiment, and therefore, as regards a redundant portion, the drawing and description will be omitted or briefly made, and the same reference numerals or symbols are added to the same constituent elements, and in the following, a portion different from the third embodiment will be principally described.

Figure 13:
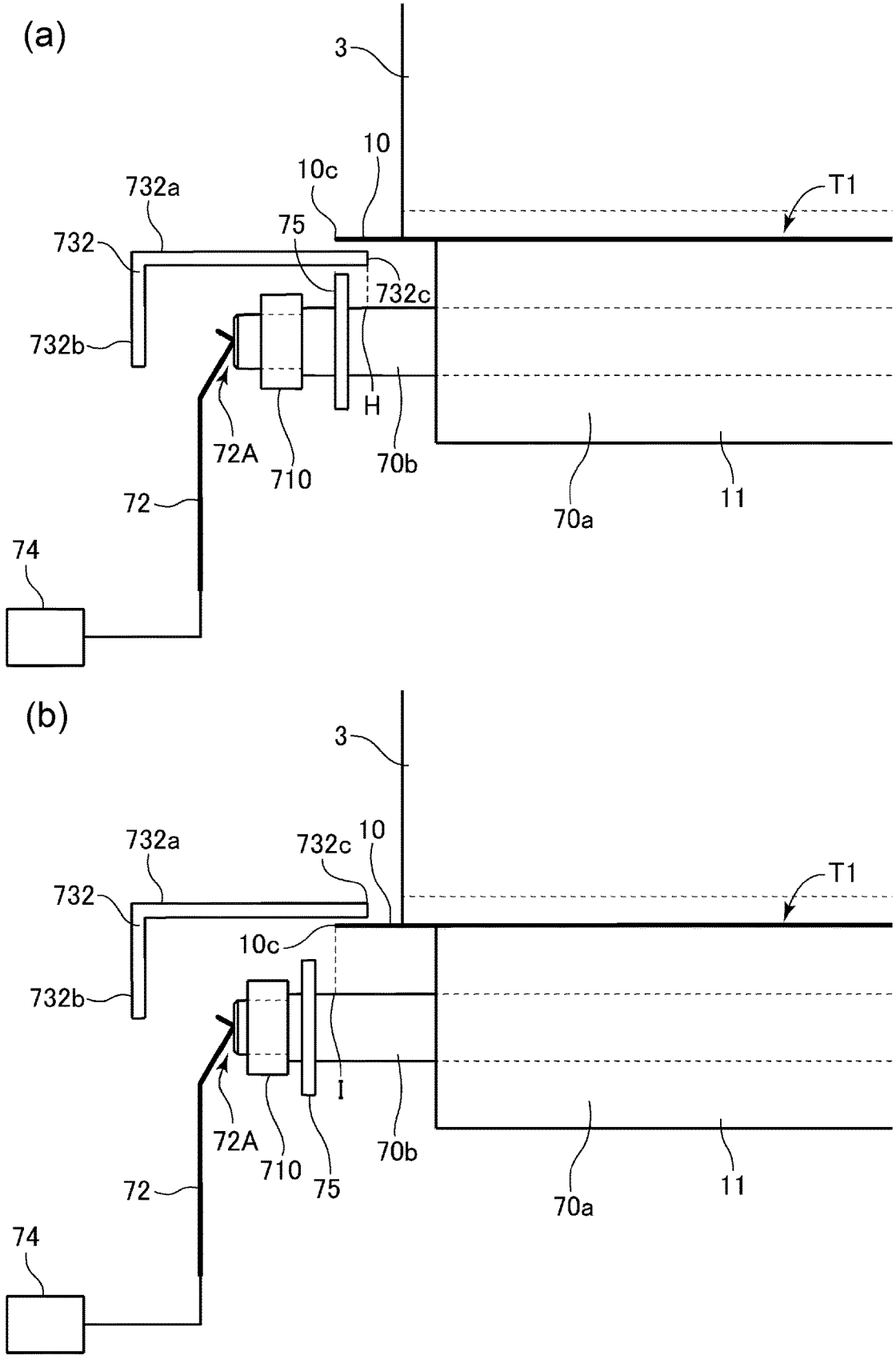
FIG. 13 includes side views each showing a schematic structure of a primary transfer portion according to a sixth embodiment on an end portion side in a state in which an intermediary transfer belt is cut, in which part (a) shows the primary transfer portion according to a first example, and part (b) shows the primary transfer portion according to a second example.

In part (a) of FIG. 13, a constitution of a first example of this embodiment is shown. In the first example, the cover member 732 is disposed so that a roller portion side (front side) end portion 732*c* is positioned below a portion of the intermediary transfer belt 10 projected more than the end portion of the contact roller portion 70*a* is. That is, compared with the constitution of the third embodiment shown in FIG. 10, the cover portion 732*a* of the cover member 732 is extended toward the intermediary transfer belt 10 side, and an extended free end portion is caused to enter an inside of the intermediary transfer belt 10. By this, a front side portion of the cover member 732 and a front side portion of the intermediary transfer belt 10 are caused to overlap with each other with respect to the up-down direction. Incidentally, a structure of the rear side bent portion 732*b* of the cover member 732 is the same as that in the third embodiment.

Thus, by causing the cover member 732 and the intermediary transfer belt 10 to partially overlap with each other, it is possible to restrict a range in which the liquid developer drops onto the electroconductive shaft portion 70*b* from the cover member 732 and the intermediary transfer belt 10. In the case of the first example of this embodiment, as shown in part (a) of FIG. 13, the liquid developer moved on the surface of the intermediary transfer belt 10 drops onto the cover member 732 from the end portion 10*c*. For this reason, a drop range of the liquid developer onto the electroconductive shaft portion 70*b* can be restricted to a position H below the front side end portion 732*c* of the cover member 732.

On the other hand, in part (b) of FIG. 13, a constitution of a second example of this embodiment is shown. In the first example, the cover member 732 is disposed so that a roller portion side (front side) end portion 732*c* is positioned above a portion of the intermediary transfer belt 10 projected more than the end portion of the contact roller portion 70*a* is. That is, compared with the constitution of the third embodiment shown in FIG. 10, the cover portion 732*a* of the cover member 732 is extended toward the intermediary transfer belt 10 side, and an extended free end portion is caused to enter an outside of the intermediary transfer belt 10. By this, a front side portion of the cover member 732 and a front side portion of the intermediary transfer belt 10 are caused to overlap with each other with respect to the up-down direction.

Further, in the second example of this embodiment, the flange 75 is positioned, in a second position where the transfer unit is inclined during maintenance or the like, below the rear side end portion 10*c* of the intermediary transfer belt 10 with respect to the direction of gravitation. For this reason, even in a state in which the transfer unit is inclined to the second position, the liquid developer flowing along the surface of the electroconductive shaft portion 70*b* is blocked, so that it is possible to suppress that the liquid developer reaches the electrode contact portion 72A.

In the case of the second example of this embodiment, as shown in part (b) of FIG. 13, the liquid developer moved on the surface of the cover member 732 drops onto the intermediary transfer belt 10 from the end portion 732*c*. For this reason, a drop range of the liquid developer onto the electroconductive shaft portion 70*b* can be restricted to a position L below the rear side end portion 10*c* of the intermediary transfer belt 10.

Further, in either case of the first example and the second example of this embodiment, the flange 75 is provided between the position H where the liquid developer drops and the electrode contact portion 72A and between the position I where the liquid drops and the bearing 710. By this, it is possible to efficiently suppress that the liquid developer dropped on the electroconductive shaft portion 70*b* reaches the electrode contact portion 72A and the bearing 710.

Seventh Embodiment

Figure 14:
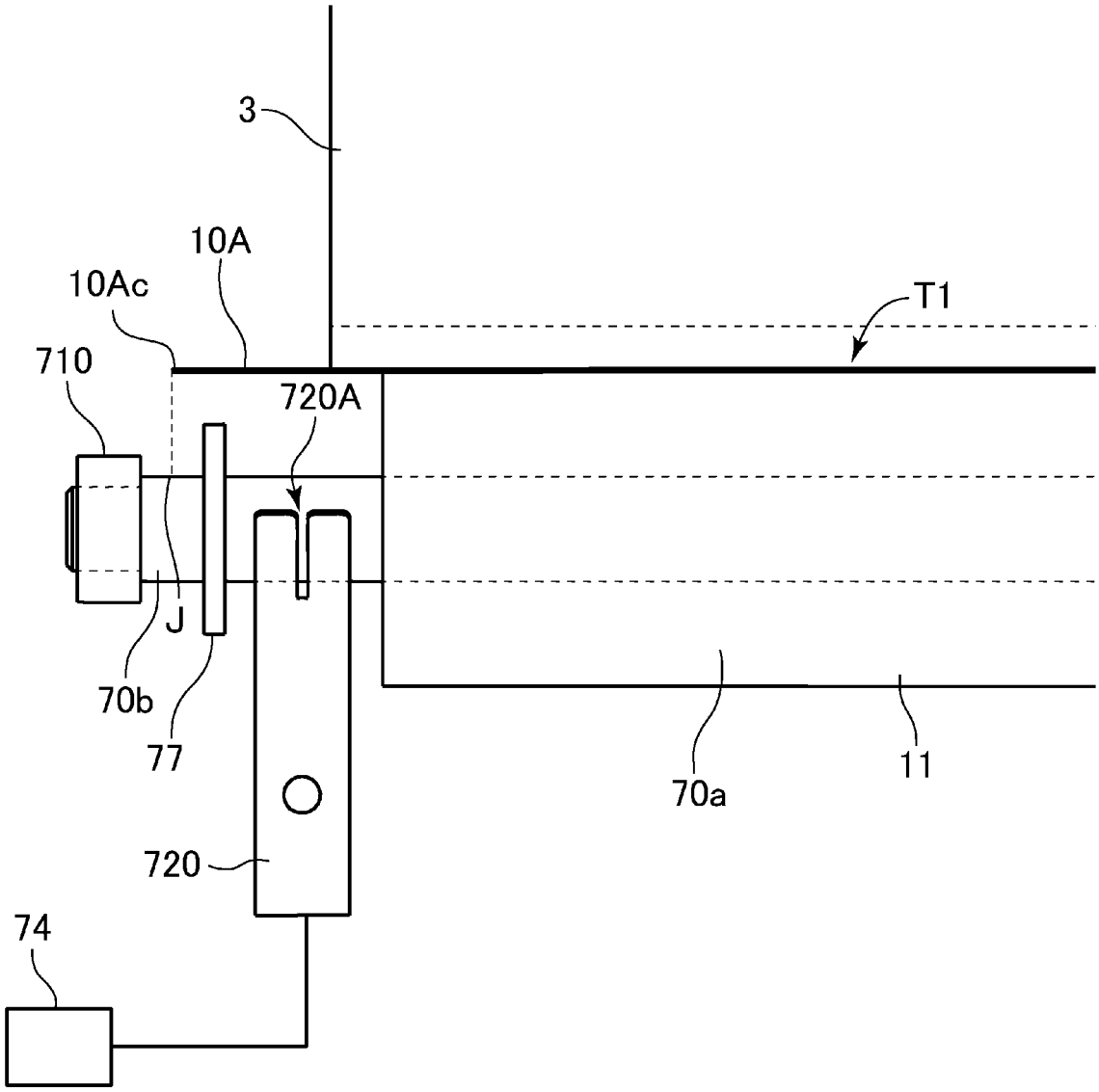
FIG. 14 is a side view showing a schematic structure of the primary transfer portion according to a seventh embodiment on an end portion side in a state in which the intermediary transfer belt is cut.

A seventh embodiment will be described using FIG. 14. In the above-described third embodiment, the constitution in which the portion above the electrode contact portion 72A is covered by the cover member 73 was described. On the other hand, in this embodiment, a portion above an electrode contact portion 720A is covered by the intermediary transfer belt 10A. Incidentally, an electrode member 720 contacts a circumferential surface of the electroconductive shaft portion 70*b* at the electrode contact portion 720A similarly as in the above-described fourth embodiment. Other constitutions and actions are similar to those in the above-described third or fourth embodiment, and therefore, as regards a redundant portion, the drawing and description will be omitted or briefly made, and the same reference numerals or symbols are added to the same constituent elements, and in the following, a portion different from the third or fourth embodiment will be principally described.

In the case of this embodiment, the contact roller portion 70*a* of the primary transfer roller 11 contacts the intermediary transfer belt 10 further inside than the location of an end portion 10Ac of the intermediary transfer belt 10. In other words, the rear side end portion 10Ac of the intermediary transfer belt 10 with respect to the intermediary transfer belt 10A projects further in the axial direction than the end portion of the contact roller portion 70*a* with respect to the axial direction does.

Further, the electrode member 720 contacts the electroconductive shaft portion 70*b* below the portion of the intermediary transfer belt 10A projected more than the contact roller portion 70*a* is. In other words, a portion above the electrode contact portion 720A where the electrode member 720 and the electroconductive shaft portion 70*b* contact each other is covered by a part of the intermediary transfer belt 10A.

Further, in this embodiment, at an end portion of the primary transfer roller 11, a flange 77 as a restricting member for the belt is provided. The flange 77 is provided, with respect to the axial direction of the primary transfer roller 11, between a front side end portion 10Ac of the intermediary transfer belt 10A with respect to the widthwise direction and the electrode contact portion 720A, and restricts that the liquid developer reaches the electrode contact portion 720A from the end portion 10Ac of the intermediary transfer belt 10A. The flange 77 has the same constitution as that of the flange 75 in the third embodiment.

Accordingly, in this embodiment, the electrode contact portion 720A is disposed between the contact roller portion 70*a* and the flange 77. The bearing 710 is provided at an end portion of the electroconductive shaft portion 70*b*. Further, a portion above the electrode contact portion 720A and the flange 77 is covered by a portion of the intermediary transfer belt 10A projected from the contact roller portion 70*a*.

In such a case of this embodiment, the liquid developer on the intermediary transfer belt 10A flows along the surface of the intermediary transfer belt 10A and drops onto a position J of the electroconductive shaft portion 70*b* from the end portion 10Ac. The position J is a position below the end portion 10Ac of the intermediary transfer belt 10A with respect to the vertical direction.

The liquid developer dropped in the position J in this manner moves in the axial direction along the surface of the electroconductive shaft portion 70*b* in some cases. However, in this embodiment, the flange 77 with no through hole is provided on the electroconductive shaft portion 70*b* between the position J and the electrode contact portion 720A. For this reason, the liquid developer flowing along the surface of the electroconductive shaft portion 70*b* is blocked by the flange 77 and drops downward by gravitation, so that it is possible to suppress that the liquid developer reaches the electrode contact portion 720A.

Further, the contact portion 720A is positioned further on the front side than the position J, and therefore, in a state in which the transfer unit is inclined to a second position, the electrode contact portion 720A is positioned above the position J with respect to the direction of gravitation. For this reason, in this state, it is possible to suppress that the liquid developer dropped on the electroconductive shaft portion 70*b* reaches the electrode contact portion 720A.

Other Embodiments

In the above-described first and second embodiments, a constitution in which at least the cleaning container 16 is supported by the supporting units 104 and 104A was described. However, other than the cleaning container 16, for example, a container for collecting the liquid developer dropped from the surface of the intermediary transfer belt, or the like may also be supported by the holding members such as the supporting units 104 and 104A or the like.

That is, a collecting portion capable of collecting the liquid developer dropped from at least a part of the transfer unit may also be supported by the holding members such as the supporting units 104 and 104A or the like. By thus-constituting the collecting portion, even when the transfer unit is inclined during the maintenance, it is possible to suppress that the liquid developer leaks to an unintended portion.

Further, in the above-described third to seventh embodiments, the constitution in which the electrode member is contacted to the electroconductive shaft portion and energization is carried out was described. However, the energizing constitution may also be, for example, a constitution using a member slidable with the electroconductive shaft portion, such as a constitution utilizing a bearing member for supporting the electroconductive shaft portion.

Further, the contact roller may also be, other than the primary transfer roller 11, for example, the secondary transfer outer roller 12*b* or the cleaning roller 15 or the like. That is, if the contact roller is a roller which contacts the intermediary transfer belt and to which the voltage is applied, the constitutions of the above-described third and seventh embodiments are similarly applicable to the rollers. Incidentally, in the case of a constitution in which the voltage is applied to the secondary transfer inner roller 12*a*, the above-described constitution may preferably be applied to the secondary transfer inner roller 12*a*. Further, the electrode member may also be used for connection required for electrical conduction, for example, grounding connection, in addition to connection to the energizing portion such as the high-voltage source. Further, the roller to be provided with the flange portion may also be the photosensitive drum 3 in addition to the above-described rollers. Further, the roller may also be rollers contacting the photosensitive drum 3, for example, the developing roller for developing the latent image formed on the photosensitive drum 3 and the charging roller for electrically charging the photosensitive drum 3.

Further, in the above-described third to seventh embodiments, the constitution in which the transfer unit as described in the first embodiment is inclined to the second position was described. However, the third to seventh embodiments are also applicable to the constitution in which the transfer unit is in the first position as it is in the first embodiment. Incidentally, the above-described respective embodiments are capable of being carried out appropriately in combination. Further, from the viewpoint of suppressing leakage of the liquid developer when the transfer unit is inclined, the flange may also have a constitution in which the flange is provided only on an apparatus rear side (rotation supporting point side of the transfer unit) with respect to the axial direction of the primary transfer roller.

INDUSTRIAL APPLICABILITY

According to the present invention, there is provided an image forming apparatus in which leakage of the liquid developer is capable of being suppressed in a constitution in which the transfer unit is inclined.

The invention claimed is:

1. An image forming apparatus comprising:

an image bearing member for bearing an image formed with a developer containing toner and a carrier;

an endless intermediary transfer belt onto which the image is transferred from said image bearing member;

a transfer roller for transferring the image onto said intermediary transfer belt, wherein said transfer roller includes a roller portion contacting an inner peripheral surface of said intermediary transfer belt and a shaft portion having a diameter smaller than a diameter of said roller portion on an outside of said roller portion with respect to an axial direction of said transfer roller;

a bearing portion for rotatably supporting said shaft portion;

a flange portion provided between said roller portion and said bearing portion with respect to the axial direction of said transfer roller;

a transfer unit for supporting said intermediary transfer belt;

a supporting unit which supports said transfer unit and which is constituted so as to be movable between a first position where said supporting unit is mounted in an apparatus main assembly and a second position where said supporting unit is pulled out from the first position; and a cover, provided at said supporting unit, for covering above said shaft portion of said transfer roller, wherein said cover portion extends from an outside of an end portion of said shaft portion to an inside of said flange portion with respect to an axial direction of said transfer roller.

2. An image forming apparatus comprising:

an image bearing member for bearing an image formed with a developer containing toner and a carrier;

an endless intermediary transfer belt onto which the image is transferred from said image bearing member;

a transfer roller for transferring the image onto said intermediary transfer belt, wherein said transfer roller includes a roller portion contacting an inner peripheral surface of said intermediary transfer belt and a shaft portion having a diameter smaller than a diameter of said roller portion on an outside of said roller portion with respect to an axial direction of said transfer roller;

a bearing portion for rotatably supporting said shaft portion;

a flange portion provided between said roller portion and said bearing portion with respect to the axial direction of said transfer roller; and a transfer unit for integrally supporting said intermediary transfer belt and said transfer roller, wherein said transfer unit is constituted so that after said transfer unit is pulled out from an apparatus main assembly, with one end side as a supporting point, with respect to a widthwise direction of said intermediary transfer belt, the other end side is rotatable upward, and wherein said flange portion is provided at least on said one end side with respect to the axial direction of said transfer roller.

3. An image forming apparatus comprising:

an image bearing member for bearing an image formed with a developer containing toner and a carrier;

an endless intermediary transfer belt onto which the image is transferred from said image bearing member;

a transfer roller for transferring the image onto said intermediary transfer belt, wherein said transfer roller includes a roller portion contacting an inner peripheral surface of said intermediary transfer belt and a shaft portion having a diameter smaller than a diameter of said roller portion on an outside of said roller portion with respect to an axial direction of said transfer roller;

a bearing portion for rotatably supporting said shaft portion;

an electrical contact portion, contacting said shaft portion at a contact portion, for supplying a bias to said shaft portion;

a flange portion positioned between said roller portion and said electrical contact portion with respect to the axial direction of said transfer roller;

a transfer unit for supporting said intermediary transfer belt;

a supporting unit which supports said transfer unit and which is constituted so as to be movable between a first position where said supporting unit is mounted in an apparatus main assembly and a second position where said supporting unit is pulled out from the first position; and a cover, provided at said supporting unit, for covering above said shaft portion of said transfer roller, wherein said cover portion extends from an outside of an end portion of said shaft portion to an inside of said flange portion with respect to the axial direction of said transfer roller.

4. An image forming apparatus comprising:

an image bearing member for bearing an image formed with a developer containing toner and a carrier;

an endless intermediary transfer belt onto which the image is transferred from said image bearing member;

a transfer roller for transferring the image onto said intermediary transfer belt, wherein said transfer roller includes a roller portion contacting an inner peripheral surface of said intermediary transfer belt and a shaft portion having a diameter smaller than a diameter of said roller portion on an outside of said roller portion with respect to an axial direction of said transfer roller;

a bearing portion for rotatably supporting said shaft portion;

an electrical contact portion, contacting said shaft portion at a contact portion, for supplying a bias to said shaft portion;

a flange portion positioned between said roller portion and said electrical contact portion with respect to the axial direction of said transfer roller; and a transfer unit for integrally supporting said intermediary transfer belt and said transfer roller, wherein said transfer unit is constituted so that after said transfer unit is pulled out from an apparatus main assembly, with one end side as a supporting point, with respect to a widthwise direction of said intermediary transfer belt, the other end side is rotatable upward, and wherein said flange portion is provided at least on said one end side with respect to the axial direction of said transfer roller.

* * * * *